US011192364B2

(12) United States Patent
Miwa

(10) Patent No.: US 11,192,364 B2
(45) Date of Patent: Dec. 7, 2021

(54) ELECTRO-MECHANICAL TRANSDUCER, LIQUID DISCHARGE HEAD, LIQUID DISCHARGE DEVICE, AND LIQUID DISCHARGE APPARATUS

(71) Applicant: Ricoh Company, Ltd., Tokyo (JP)

(72) Inventor: Keishi Miwa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/815,244

(22) Filed: Mar. 11, 2020

(65) Prior Publication Data

US 2020/0298569 A1 Sep. 24, 2020

(30) Foreign Application Priority Data

Mar. 19, 2019 (JP) ..... JP2019-051155

(51) Int. Cl.
*B41J 2/14* (2006.01)

(52) U.S. Cl.
CPC ..... *B41J 2/14201* (2013.01)

(58) Field of Classification Search
CPC ..... B41J 2/14201; B41J 2/161; B41J 2/1629; B41J 2/1635; B41J 2/1631; B41J 2/1642; B41J 2/1645; B41J 2/1646; B41J 2002/14459; B41J 2/14233
See application file for complete search history.

(56) References Cited

U.S. PATENT DOCUMENTS 7,479,729 B2 * 1/2009 Sugahara ..... B41J 2/1623 310/365
2006/0066684 A1 * 3/2006 Sugahara ..... B41J 2/161 347/68
2012/0069101 A1 3/2012 Kato et al.
2012/0160925 A1 6/2012 Hoisington et al.
2012/0206540 A1 8/2012 Kato et al.
2012/0206545 A1 8/2012 Kato et al.
2012/0212545 A1 8/2012 Mizukami et al.
2012/0229573 A1 9/2012 Mizukami et al.
2012/0236083 A1 9/2012 Mizukami et al.
2012/0320131 A1 12/2012 Kato et al.
2013/0021412 A1 1/2013 Nishimura et al.
(Continued)

FOREIGN PATENT DOCUMENTS

JP 2006-116954 5/2006
JP 2016-013651 1/2016
(Continued)

OTHER PUBLICATIONS

IP.com search (Year: 2021).*

*Primary Examiner* — Lisa Solomon
(74) *Attorney, Agent, or Firm* — Xsensus LLP

(57) ABSTRACT

An electro-mechanical transducer includes a diaphragm plate on a substrate, a first electrode on the diaphragm plate, an electro-mechanical transducer film on the first electrode, and a second electrode on the electro-mechanical transducer film. One of the first electrode and the second electrode is a common electrode. Another of the first electrode and the second electrode is an individual electrode. At least a portion of the common electrode is laminated on and in contact with the diaphragm plate. The common electrode has a plurality of holes penetrating the common electrode in a lamination direction.

15 Claims, 30 Drawing Sheets

(56) References Cited

U.S. PATENT DOCUMENTS

| | | | |
|---|---|---|---|
| 2013/0050354 | A1 | 2/2013 | Kato et al. |
| 2013/0070021 | A1 | 3/2013 | Nishimura et al. |
| 2015/0171307 | A1 | 6/2015 | Masuda et al. |
| 2016/0001556 | A1 | 1/2016 | Masuda et al. |
| 2017/0001441 | A1 | 1/2017 | Kato |
| 2017/0100934 | A1 | 4/2017 | Masuda et al. |
| 2017/0151782 | A1 | 6/2017 | Takahashi et al. |
| 2019/0027031 | A1 | 9/2019 | Masuda et al. |
| 2019/0275793 | A1 | 9/2019 | Kato |
| 2019/0275796 | A1 | 9/2019 | Miwa |
| 2019/0275797 | A1 | 9/2019 | Kato |

FOREIGN PATENT DOCUMENTS

| | | |
|---|---|---|
| JP | 2016-155283 | 9/2016 |
| JP | 2016-162817 | 9/2016 |
| JP | 2017-191859 | 10/2017 |

* cited by examiner

ELECTRO-MECHANICAL TRANSDUCER, LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-051155, filed on Mar. 19, 2019, in the Japan Patent Office, the entire disclosure of which is incorporated by reference herein.

BACKGROUND

Technical Field

Aspects of the present disclosure relate to an electro-mechanical transducer, a liquid discharge head, a liquid discharge device, and a liquid discharge apparatus.

Related Art

As an example of a printer, a facsimile, a copier, a plotter, or an image forming apparatus combining a plurality of functions of the foregoing devices, an inkjet recording apparatus is known that includes a liquid discharge head to discharge droplets of ink or the like.

As the liquid discharge head, for example, a liquid discharge head is known that includes nozzles to discharge droplets of liquid such as ink, liquid chambers to communicate with the nozzles and store liquid (also referred to as pressurization liquid chambers, pressure chambers, pressurization chambers, discharge chambers, or the like), and electro-mechanical transducer elements such as piezoelectric elements.

In the liquid discharge head, a voltage is applied to a piezoelectric element, and the piezoelectric element thereby vibrates so as to deform a diaphragm plate forming a part of a wall of the liquid chamber. The deformation of the diaphragm plate pressurizes the liquid in the liquid chamber to discharge droplets from the nozzle.

In an inkjet head using a piezoelectric actuator, there is a technique of laminating a lower electrode, a piezoelectric body, and an upper electrode in this order on a diaphragm plate, applying a voltage to the upper and lower electrodes to deform the piezoelectric body, and discharging ink through the diaphragm plate.

As a configuration of a piezoelectric actuator so far, for example, a configuration is known in which one of a lower electrode and an upper electrode is a common electrode and another is an individual electrode. Examples of a material for the electrodes include Pt, and examples of a material for the diaphragm plate include Si and $SiO_2$.

SUMMARY

In an aspect of the present disclosure, there is provided an electro-mechanical transducer that includes a diaphragm plate on a substrate, a first electrode on the diaphragm plate, an electro-mechanical transducer film on the first electrode, and a second electrode on the electro-mechanical transducer film. One of the first electrode and the second electrode is a common electrode. Another of the first electrode and the second electrode is an individual electrode. At least a portion of the common electrode is laminated on and in contact with the diaphragm plate. The common electrode has a plurality of holes penetrating the common electrode in a lamination direction.

In another aspect of the present disclosure, there is provided a liquid discharge head that includes a pressure chamber and the electro-mechanical transducer. The pressure chamber communicates with a nozzle configured to discharge liquid. The electro-mechanical transducer is configured to generate a pressure in the liquid in the pressure chamber.

In still another aspect of the present disclosure, there is provided a liquid discharge device including the liquid discharge head.

In still yet another aspect of the present disclosure, there is provided a liquid discharge apparatus including the liquid discharge device.

In still yet another aspect of the present disclosure, there is provided a liquid discharge apparatus including the liquid discharge head.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
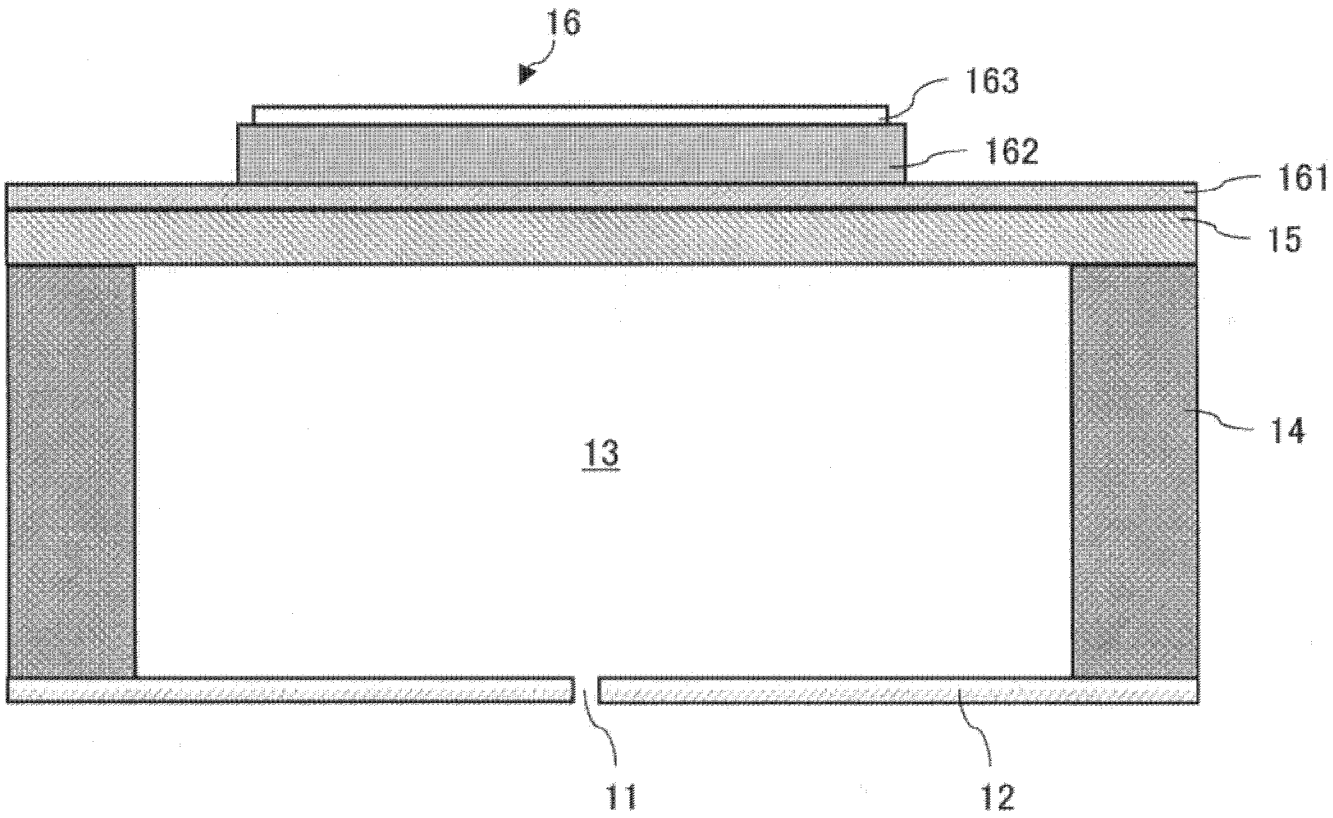
FIG. 1 is an example of a cross-sectional view illustrating a schematic configuration of a main part of an electro-mechanical transducer.

The accompanying drawings are intended to depict embodiments of the present disclosure and should not be interpreted to limit the scope thereof. The accompanying drawings are not to be considered as drawn to scale unless explicitly noted.

DETAILED DESCRIPTIONS OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

As described above, in an inkjet head using a piezoelectric actuator, there is a technique of laminating a lower electrode, a piezoelectric body, and an upper electrode in this order on a diaphragm plate, applying a voltage to the upper and lower electrodes to deform the piezoelectric body, and discharging ink through the diaphragm plate.

As a configuration of a piezoelectric actuator so far, a configuration in which one of a lower electrode and an upper electrode is a common electrode and the other is an individual electrode is known. Examples of a material for the electrodes include Pt, and examples of a material for the diaphragm plate include Si and $SiO_2$.

Due to study of the present inventor, it has been found that a corner of a common electrode (here, a case where a lower electrode is a common electrode is exemplified) may be peeled off from a diaphragm plate while the piezoelectric actuator is manufactured. When the common electrode is peeled off, a short circuit or the like occurs due to adhesion of the common electrode to an unintended portion on a piezoelectric actuator substrate, and reliability of a product is lowered.

Figure 36:
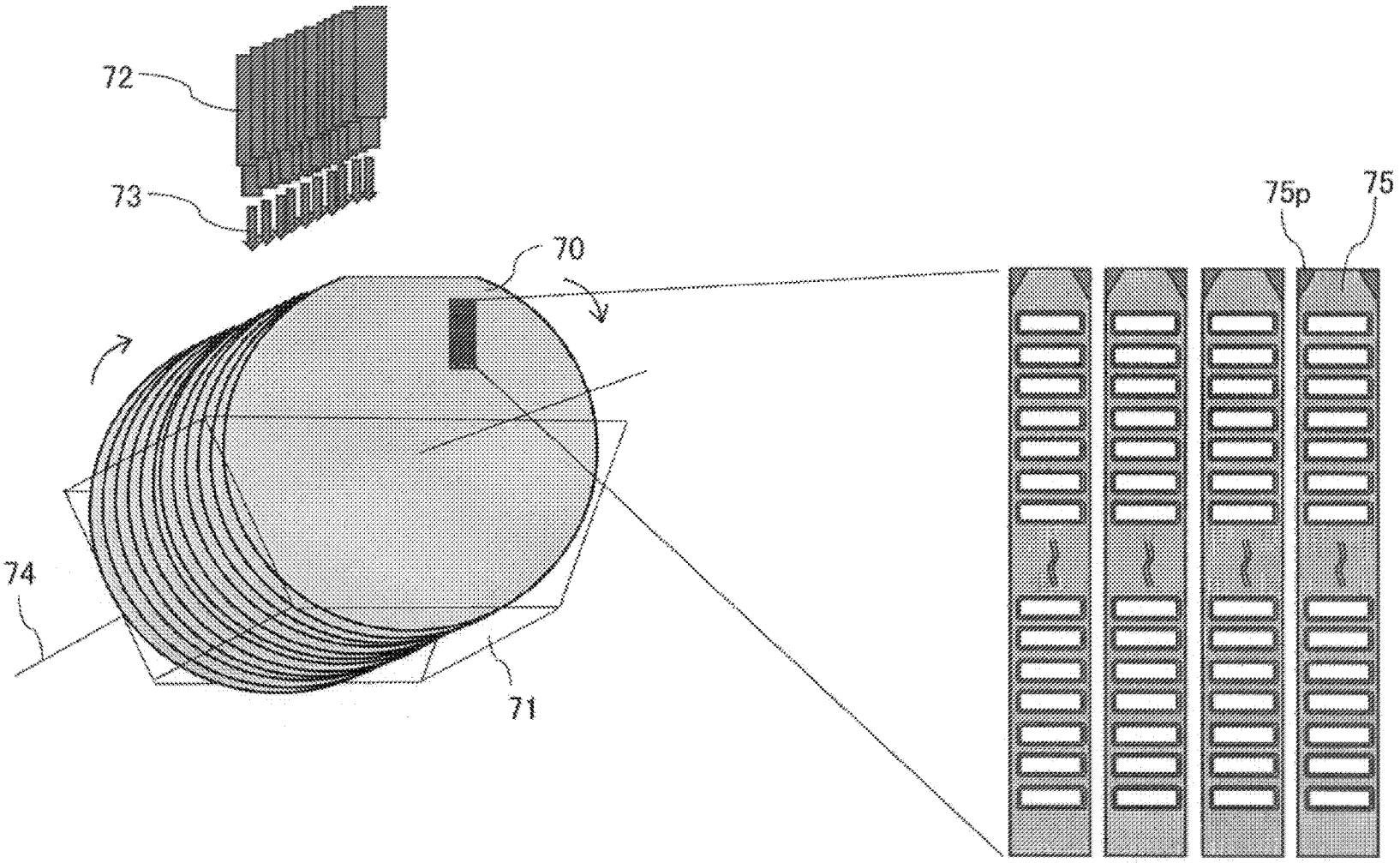
FIG. 36 is an explanatory diagram for peeling of a corner of a common electrode in a resist stripping treatment.

Specifically, when the piezoelectric actuator is patterned by photolithography etching or the like, a resist stripping treatment, an asking treatment, or the like is performed in order to remove a residue due to etching, a resist, and the like. The resist stripping treatment at this time is often performed in a batch manner in order to improve productivity. As illustrated in FIG. 36, a substrate 70 (wafer) is disposed in a substrate cassette 71, and a stripping liquid 73 is supplied to the substrate 70 from a stripping-liquid discharge nozzle 72 disposed outside the substrate 70. At this time, the substrate cassette 71 is rotated around a rotation shaft 74 such that the stripping liquid 73 spreads over the entire surface of the substrate 70 to perform the treatment. After this resist stripping treatment, peeling 75*p* of the common electrode 75 occurs as illustrated in the partially enlarged view of FIG. 36, which reduces a yield largely.

The peeling in the resist stripping treatment tends to occur particularly at a corner of the common electrode 75 having a large pattern and located outside the substrate 70. That is, the stripping liquid 73 attacks the corners (four corners) of the common electrode 75 from two directions forming the corners, and therefore easily enters the common electrode 75 and a lower layer thereof from the corners of the common electrode 75. For example, when the common electrode 75 is a lower electrode, the lower electrode is easily peeled off from the diaphragm plate.

In particular, the common electrode has a shape extending over a plurality of piezoelectric bodies, and is laid out over a relatively large area. Therefore, the common electrode is easily peeled off from an edge portion where a stress is strong and a stress is particularly likely to concentrate. In order to avoid this, for example, several techniques have been proposed.

However, it has been found that such techniques certainly reduce peeling as compared to a technique without a stress concentration pattern, but evaluation indicates that peeling has not yet been eliminated completely. Furthermore, the number of steps increases, and fundamental stress concentration cannot be avoided. Therefore, peeling may occur depending on process conditions.

In addition, a configuration in which a plurality of through holes is formed in the common electrode has been proposed, but this does not take peeling of the common electrode and the diaphragm plate into consideration.

Therefore, an object of the present disclosure is to provide an electro-mechanical transducer that suppresses peeling of the common electrode to achieve high reliability.

Hereinafter, an electro-mechanical transducer, a liquid discharge head, a liquid discharge device, and a liquid discharge apparatus according to embodiments of the present disclosure will be described with reference to the drawings. Note that the present disclosure are not limited to the embodiments described below but can be changed within a range which a person skilled in the art can conceive of, for example, by another embodiment, addition, modification, or deletion. Any aspect is included in the scope of the present disclosure as long as exhibiting an action and an effect of the present disclosure.

In an embodiment of the present disclosure, an electro-mechanical transducer includes a diaphragm plate on a substrate, a first electrode on the diaphragm plate, an electro-mechanical transducer film on the first electrode, and a second electrode on the electro-mechanical transducer film, in which one of the first electrode and the second electrode is a common electrode, another is an individual electrode, at least a portion of the common electrode is formed so as to be in contact with a layer forming the diaphragm plate, and the common electrode has a plurality of holes (also referred to as through holes) penetrating the common electrode in a lamination direction.

Electro-Mechanical Transducer and Liquid Discharge Head

Figure 2:
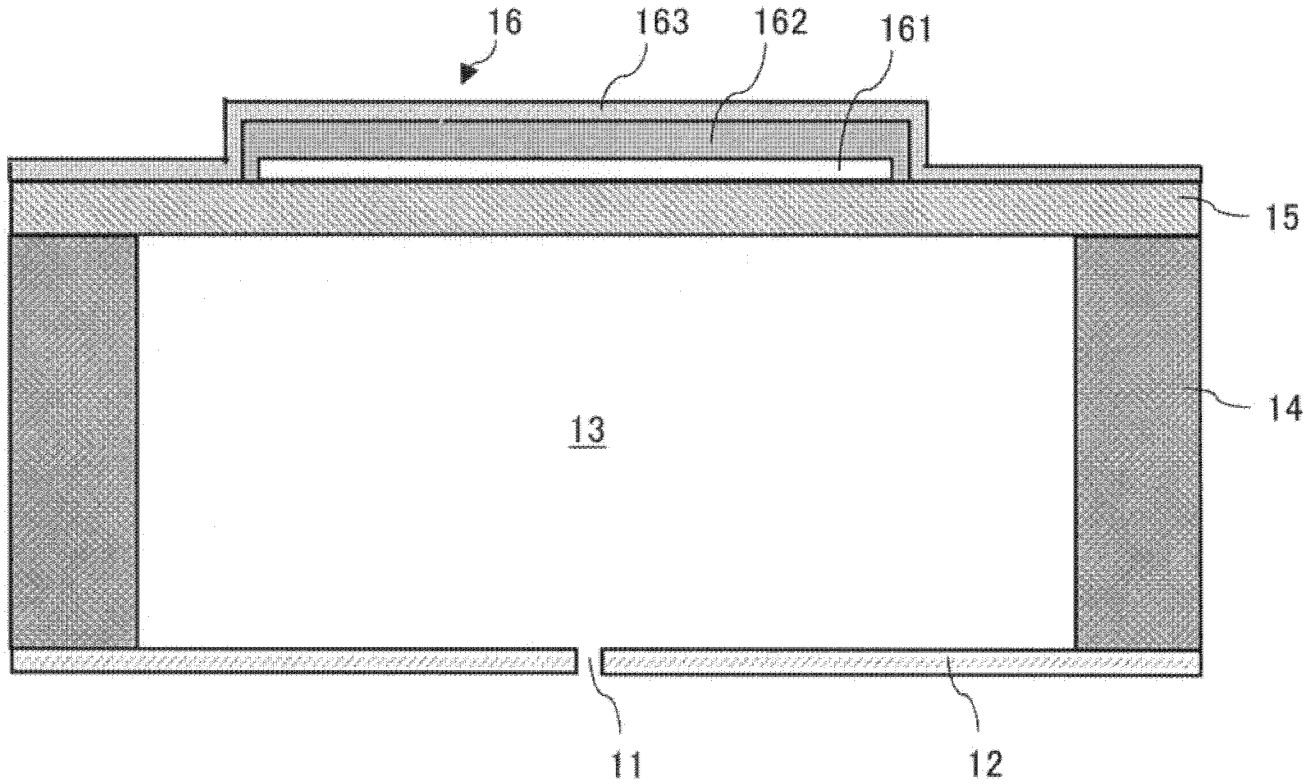
FIG. 2 is another example of a cross-sectional view illustrating a schematic configuration of a main part of an electro-mechanical transducer.

FIGS. 1 and 2 are each a cross-sectional view illustrating a schematic configuration of a portion that discharges liquid as a basic constituent portion of a liquid discharge head in an arrangement direction of liquid chambers, and illustrates only a portion corresponding to one liquid chamber for convenience. In the present embodiment illustrated in FIGS. 1 and 2, a nozzle substrate 12 having a nozzle 11 that discharges droplets of liquid such as ink, and a liquid chamber substrate 14 (hereinafter simply referred to as "substrate") in which a liquid chamber 13 (also referred to as a pressure chamber or the like) communicating with the nozzle 11 and storing liquid are included. On the substrate 14, a diaphragm plate 15 serving as one wall surface of the liquid chamber 13 is formed. On the diaphragm plate 15, an electro-mechanical transducer element 16 (also referred to as a piezoelectric element) including a lower electrode 161, an electro-mechanical transducer film 162 (also referred to as a piezoelectric body), and an upper electrode 163 is disposed.

In the electro-mechanical transducer element 16 illustrated in FIG. 1, the lower electrode 161 is a common electrode, and the upper electrode 163 is an individual electrode. Meanwhile, in the electro-mechanical transducer element 16 illustrated in FIG. 2, the lower electrode 161 is an individual electrode, and the upper electrode 163 is a common electrode.

The electro-mechanical transducer element 16 to which a driving voltage is applied vibrates so as to deform the diaphragm plate 15 between the substrate 14 and the electro-mechanical transducer element 16. The deformation of the diaphragm plate 15 pressurizes the liquid in the liquid chamber 13 to discharge droplets from the nozzle 11.

The composite laminated substrate including the substrate 14, the electro-mechanical transducer element 16, and various electrodes configured as described above is also referred to as an actuator substrate or the like.

Figure 3:
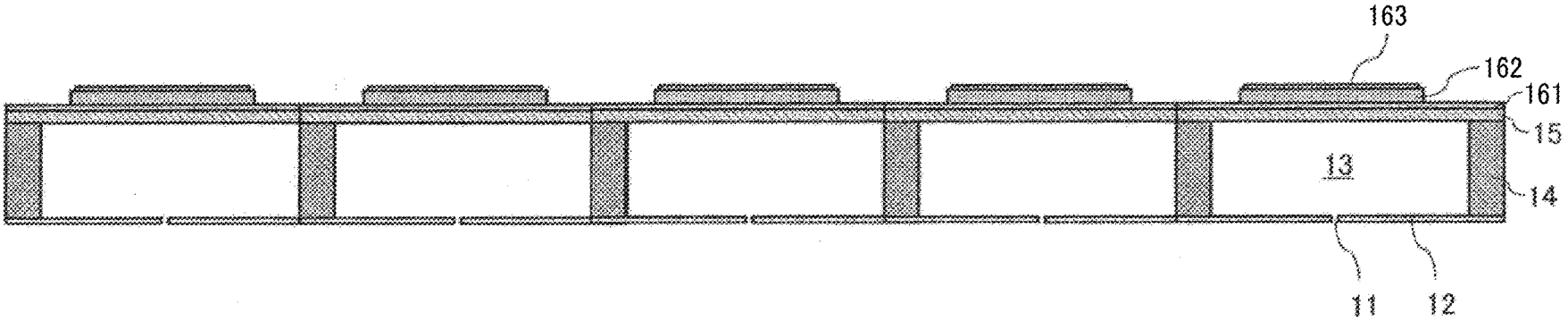
FIG. 3 is a cross-sectional view illustrating another example of the electro-mechanical transducer illustrated in FIG. 1.
Figure 4:
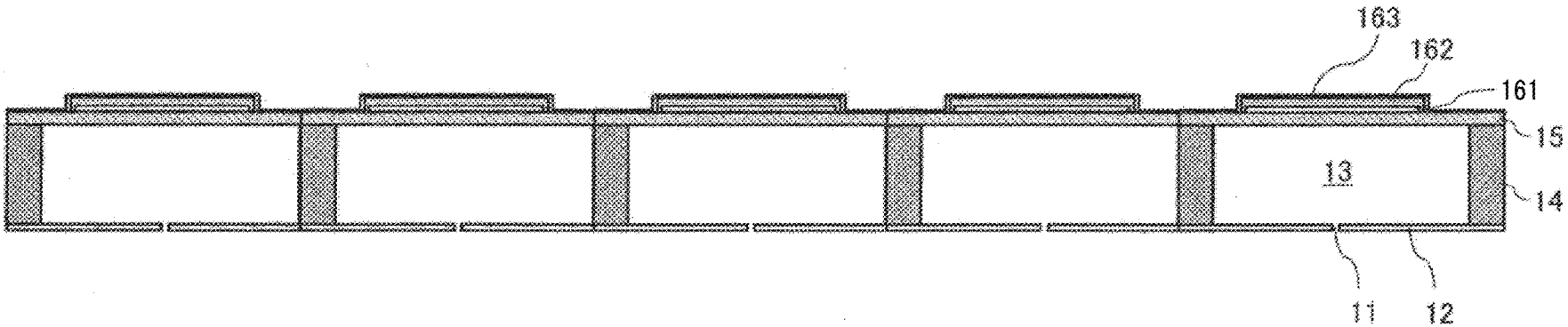
FIG. 4 is a cross-sectional view illustrating another example of the electro-mechanical transducer illustrated in FIG. 2.

FIGS. 3 and 4 illustrate examples in which a plurality of the configurations illustrated in FIGS. 1 and 2 is disposed, respectively. As described above, one of the lower electrode 161 and the upper electrode 163 is a common electrode, and another is an individual electrode.

According to the present embodiment, the electro-mechanical transducer element in the figures can be formed by a simple manufacturing step (so as to have performance equivalent to that of bulk ceramics). Thereafter, etching is removed from a back surface for forming a pressure chamber, and a nozzle plate having a nozzle hole is bonded to form a liquid discharge head.

In the present embodiment, at least a part of the common electrode is formed so as to be in contact with a layer forming the diaphragm plate. The "layer forming the diaphragm plate" means that not only a portion that vibrates but al so a portion that does not vibrate is included. For example, in FIG. 1, not only a portion of the diaphragm plate 15 on the liquid chamber 13 (pressure chamber) but also a portion of the diaphragm plate 15 secured by the substrate 14 is included.

In this way, at least a part of the common electrode is formed so as to be in contact with a layer forming the diaphragm plate to obtain the electro-mechanical transducer having the configuration illustrated in FIG. 1 or 2.

Next, each portion that is a constituent element forming the liquid discharge head, a material such as a member, and a method will be described more specifically.

Substrate

As the substrate 14, a silicon single crystal substrate is preferably used, and usually, the substrate 14 preferably has a thickness of 100 to 600 μm. There are three types of plane orientations: (100), (110) and (111), but in general, (100) and (111) are widely used in a semiconductor industry. A single crystal substrate with a (100) plane orientation is mainly used in the present configuration.

In a case where a pressure chamber as illustrated in FIG. 1 or 2 is manufactured, a silicon single crystal substrate is processed using etching. As an etching method in this case, in general, anisotropic etching is used. Anisotropic etching utilizes a property that the etching rate differs depending on a plane orientation of a crystal structure. For example, in anisotropic etching in which a substrate is immersed in an alkaline solution such as KOH, the etching rate of the plane (111) is about 1/400 that of the plane (100). Therefore, in the plane orientation (100), a structure with an inclination of about 54° can be manufactured. Meanwhile, in the plane orientation (110), a deep groove can be formed, and therefore it is known that arrangement density can be increased while rigidity is maintained. In the present configuration, a single crystal substrate having the plane orientation (110) can also be used. However, in this case, $SiO_2$ which is a mask material is also etched, and therefore the single crystal substrate is preferably used while this point is taken into consideration.

Diaphragm Plate

In response to a force generated by the electro-mechanical transducer film, a base (diaphragm plate) is deformed and displaced, and liquid (for example, ink) in the pressure chamber is discharged. Therefore, the diaphragm plate 15 preferably has a predetermined strength. Examples of a material thereof include Si, $SiO_2$, $Si_3N_4$, and $Al_2O_3$, and for example, those prepared by a chemical vapor deposition (CVD) method are used.

A film thickness is preferably 0.1 μm to 10 μm. When the thickness is 0.1 μm or more, it is easy to process the pressure chamber. When the thickness is 10 μm or less, the diaphragm plate 15 is easily deformed and displaced, and ink droplets can be discharged more stably.

First electrode (common electrode or individual electrode) The first electrode (also referred to as lower electrode or the like) preferably includes a metal or a metal and an oxide. The first electrode preferably includes an adhesion layer, and the adhesion layer is preferably disposed on a side of the diaphragm plate to be in contact with the diaphragm plate. In both configurations of FIGS. 1 and 2, it is preferable to form an adhesion layer between the diaphragm plate and the metal film to suppress peeling and the like.

—Adhesion Layer—

As the adhesion layer, preferably, Ti is sputtered to form a film, and then the titanium film is thermally oxidized in an $O_2$ atmosphere using a rapid thermal annealing (RTA) apparatus at 650° C. to 800° C. for one minute to 30 minutes to form the titanium film into a titanium oxide film. Reactive sputtering may be used to form the titanium oxide film, but the titanium film is preferably thermally oxidized at a high temperature. In manufacture by reactive sputtering, a silicon substrate needs to be heated at a high temperature, and therefore a special sputtering chamber configuration is needed. In addition, crystallinity of the titanium $O_2$ film is better in oxidation by the RTA apparatus than in oxidation by a general furnace. This is because, according to oxidation by a normal heating furnace, a titanium film that is easily oxidized forms several crystal structures at a low temperature, and therefore it is necessary to break the crystal structures once. Therefore, oxidation by RTA having a high temperature rising rate is advantageous for forming a good crystal. As a material other than Ti, materials such as Ta, Ir, and Ru are preferably used.

A film thickness is preferably 10 nm to 50 nm, and more preferably 15 nm to 30 nm. When the thickness is 10 nm or more, adhesion can be secured. When the thickness is 50 nm or less, an influence on the quality of a crystal of an electrode film manufactured on the adhesion film can be reduced.

—Metal Electrode Film—

As a metal material, platinum (Pt) having high heat resistance and low reactivity has been used conventionally. However, platinum does not have a sufficient barrier property against lead used in lead zirconate titanate (PZT) in some cases. Examples of the metal material include platinum group elements such as iridium and platinum-rhodium and alloy films of these elements.

In addition, when platinum is used, the above adhesion layer is preferably laminated first because there is a concern about adhesion to a base (particularly $SiO_2$). As a manufacturing method, vacuum film formation such as a sputtering method or a vacuum vapor deposition method is generally used.

A film thickness is preferably 80 nm to 200 nm, and more preferably 100 nm to 150 nm. When the thickness is 80 nm or more, a sufficient current can be supplied as a common electrode, and occurrence of problems when ink is discharged can be reduced. When the thickness is 200 nm or less, cost can be reduced in a case where an expensive material of a platinum group element is used. In a case where platinum is used as a material, surface roughness is prevented from increasing when the film thickness is increased, an influence on the surface roughness and crystal orientation of an oxide electrode film and PZT manufactured on a platinum film can be reduced, and a sufficient displacement for ink discharge is easily secured.

Electro-Mechanical Transducer Film (Piezoelectric Body or Piezoelectric Film)>

PZT was mainly used as a material for the electromechanical transducer film (also referred to as a piezoelectric body or a piezoelectric film). PZT is a solid solution of lead zirconate ($PbTiO_3$) and titanic acid ($PbTiO_3$), and the characteristics thereof differ depending on a ratio therebetween. In general, as a composition exhibiting excellent piezoelectric characteristics, a ratio between $PbZrO_3$ and $PbTiO_3$ is 53:47, which is indicated by $Pb(Zr_{0.53},Ti_{0.47})O_3$ in a chemical formula, and is indicated by PZT(53/47) in general.

Examples of a composite oxide other than PZT include barium titanate. In this case, a barium alkoxide and a titanium alkoxide compound are used as starting materials and dissolved in a common solvent to manufacture a barium titanate precursor solution.

These materials are described by a general formula $ABO_3$, and correspond to composite oxides mainly containing Pb, Ba, or Sr as A and containing Ti, Zr, Sn, Ni, Zn, Mg, or Nb as B. Specific description thereof is $(Pb_{1-x},Ba)(Zr,Ti)O_3$ or $(Pb_{1-x},Sr)(Zr,Ti)O_3$, which is obtained by partially substituting Ba or Sr for Pb at the site A. Such substitution is possible with a divalent element, and an effect thereof is to reduce deterioration of characteristics due to evaporation of lead during a heat treatment.

As a manufacturing method, the composite oxides can be manufactured with a spin coater by a sputtering method or a sol-gel method. In this case, since patterning is required, a desired pattern is obtained by photolithography etching or the like.

When PZT is manufactured by the sol-gel method, lead acetate, a zirconium alkoxide, or a titanium alkoxide compound is used as a starting material, and dissolved in methoxyethanol as a common solvent to obtain a uniform solution, thus manufacturing a PZT precursor solution. Since the metal alkoxide compound is easily hydrolyzed by moisture in the atmosphere, an appropriate amount of a stabilizer such as acetylacetone, acetic acid, or diethanolamine may be added to the precursor solution as a stabilizer.

When a PZT film is formed on the entire surface of the substrate, a coating film is formed by a solution coating method such as spin coating, and subjected to various heat treatments such as solvent drying, thermal decomposition, and crystallization. Since a transformation from the coating film to a crystallized film involves volume shrinkage, it is preferable to adjust the precursor concentration such that a film thickness of 100 nm or less can be obtained in a single step in order to obtain a crack-free film.

The film thickness of the electro-mechanical transducer film is preferably 0.5 μm to 5 μm, and more preferably 1 μm to 3 μm. When the thickness is 0.5 μm or more, a sufficient displacement is easily generated. When the thickness is 5 μm or less, the number of steps when multiple layers are laminated can be suppressed, and process time can be shortened.

A relative dielectric constant is preferably 600 or more and 2000 or less, and more preferably 1200 or more and 1600 or less. When the relative dielectric is within this range, sufficient displacement characteristics are easily obtained. When the relative dielectric is 2000 or less, a polarization treatment can be easily performed, and displacement deterioration after continuous driving can be reduced.

Second Electrode (Common Electrode or Individual Electrode)

The second electrode (also referred to as an upper electrode or the like) preferably includes a metal or an oxide and a metal. Details of the oxide electrode film and the metal electrode film are described below.

—Oxide Electrode Film—

$Sr_2RuO_4$ or the like is used. A film thickness is preferably 20 nm to 80 nm, and more preferably 40 nm to 60 nm. When the film is thinner than this film thickness range, sufficient characteristics cannot be obtained for an initial displacement and displacement deterioration characteristics. When the film has a thickness exceeding this range, the dielectric strength of a PZT film formed thereafter is very poor and easily causes leak.

—Metal Electrode Film—

A material and the like are described in the column of the metal electrode film used in the first electrode, and a film thickness is preferably 30 nm to 200 nm, and more preferably 50 nm to 120 nm. When the thickness is 30 nm or more, a sufficient current is easily supplied as an electrode, and problems in discharging ink can be reduced. When the thickness is 200 nm or less, cost can be reduced in a case where an expensive material of a platinum group element is used. In a case where platinum is used as a material, surface roughness is prevented from increasing when the film thickness is increased, and process problems such as film peeling can be reduced when an electrode is manufactured through an insulating protective film.

The common electrode includes an adhesion layer in contact with the diaphragm plate and a metal electrode film on the adhesion layer. The adhesion layer includes $TiO_2$, and the metal electrode film preferably includes Pt. In this case, an adhesion between the diaphragm plate and the common electrode can be improved, and a sufficient current is easily supplied as an electrode.

When the common electrode includes an adhesion layer and a metal electrode film, the diaphragm plate preferably has a laminated structure, and a layer in contact with the adhesion layer preferably includes Si, $SiO_2$, $Al_2O_3$, or $Si_3N_4$. In this case, the adhesion between the common electrode and the diaphragm plate can be further increased, and peeling of the common electrode can be further suppressed.

Configurations of Common Electrode and Through Hole

Next, configurations of the common electrode and the through hole will be described in detail. The present embodiment will be described with reference to FIGS. 5A, 5B, 6A, and 6B.

Figure 5A:
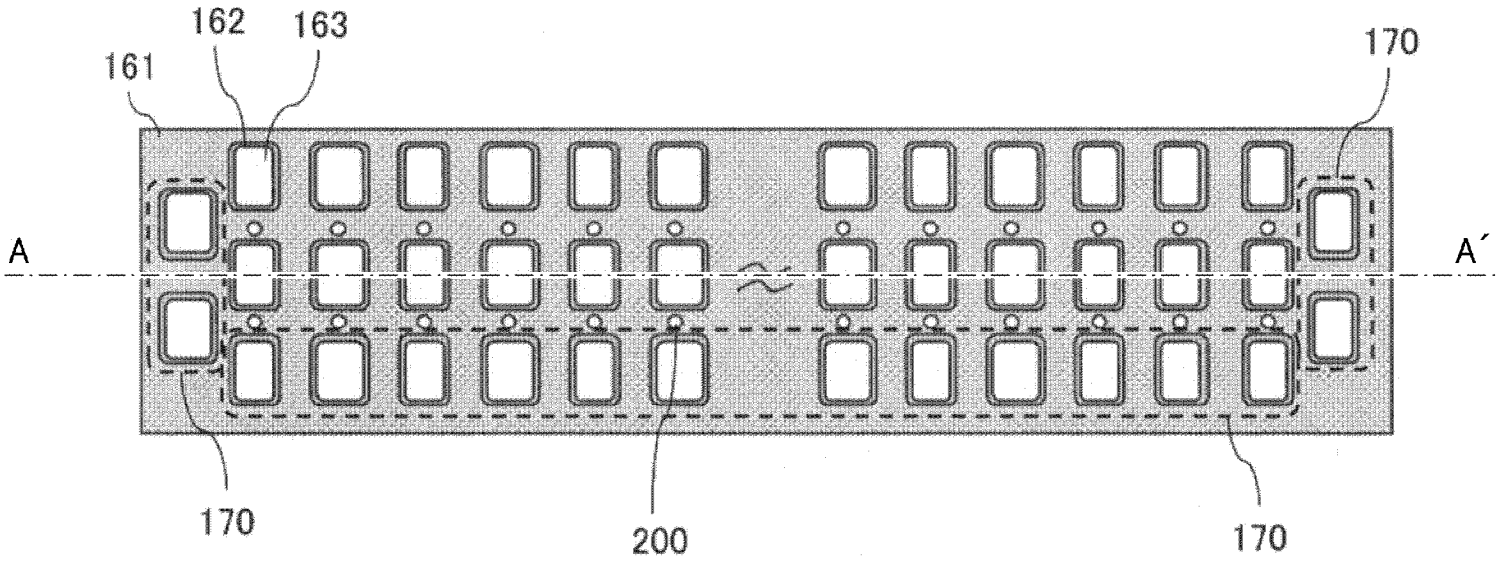
FIG. 5A is a plan view of a patterned upper electrode, electro-mechanical transducer film, and lower electrode (A)
Figure 5B:
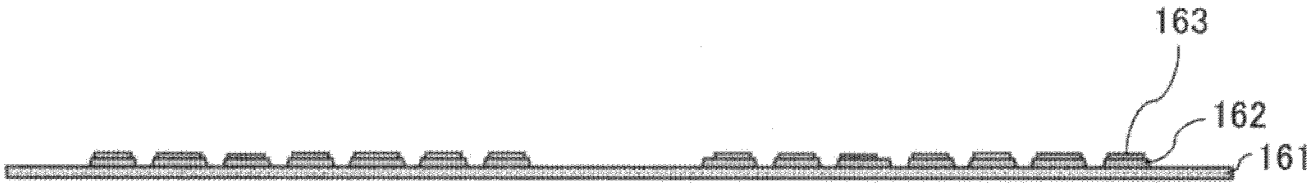
FIG. 5B is a cross-sectional view thereof cut along A-A'.

FIG. 5A schematically illustrates a top view and FIG. 5B schematically illustrates a cross-sectional view of FIG. 5A cut along A-A' when the upper electrode 163, the electro-mechanical transducer film 162, and the lower electrode 161 are patterned. In the example illustrated in FIGS. 5A and 5B, the lower electrode 161 is a common electrode, and the upper electrode 163 is an individual electrode.

Figure 6A:
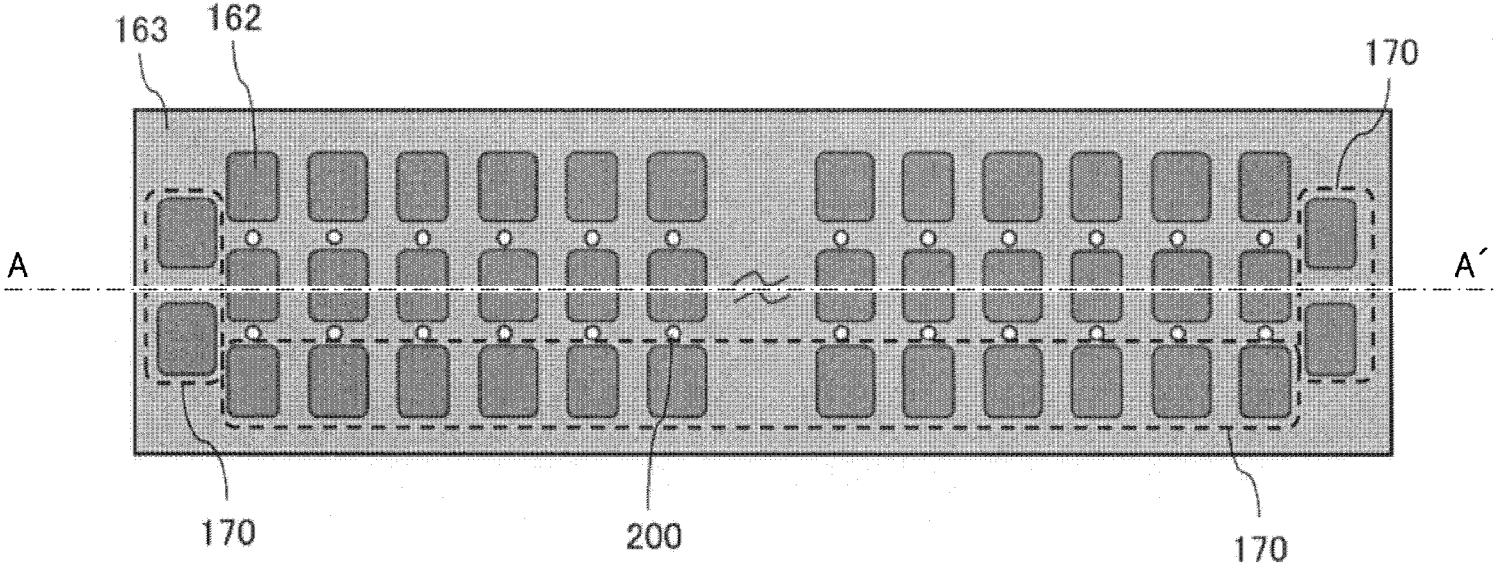
FIG. 6A is a plan view of a patterned upper electrode, electro-mechanical transducer film, and lower electrode (A)
Figure 6B:
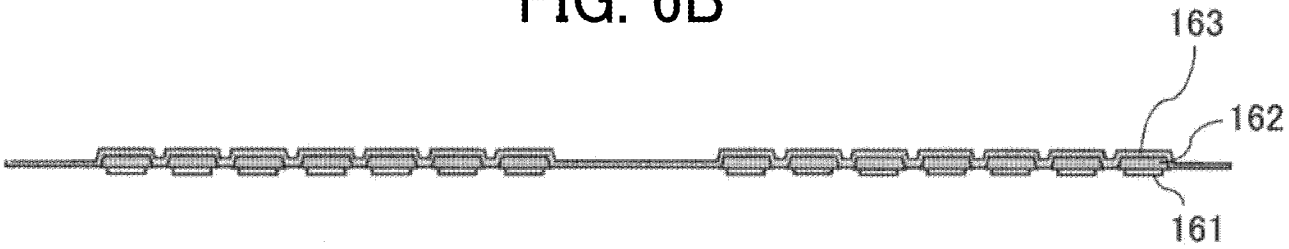
FIG. 6B is a cross-sectional view thereof cut along A-A'.

Another form is illustrated in FIGS. 6A and 6B. Similarly to FIGS. 5A and 5B, FIG. 6A schematically illustrates a top view and FIG. 6B schematically illustrates a cross-sectional view of FIG. 6A cut along A-A' when the electro-mechanical transducer film 162 is patterned. In FIGS. 6A and 6B, the lower electrode 161 is an individual electrode, and the upper electrode 163 is a common electrode.

Here, conventional disadvantages will be described. When an electro-mechanical transducer film, an individual electrode, or the like is patterned by lithography, a resist stripping treatment, an ashing treatment, or the like is performed in order to remove an etching residue or a resist. The resist stripping treatment is often performed in a batch manner from a viewpoint of improving productivity.

Figure 35:
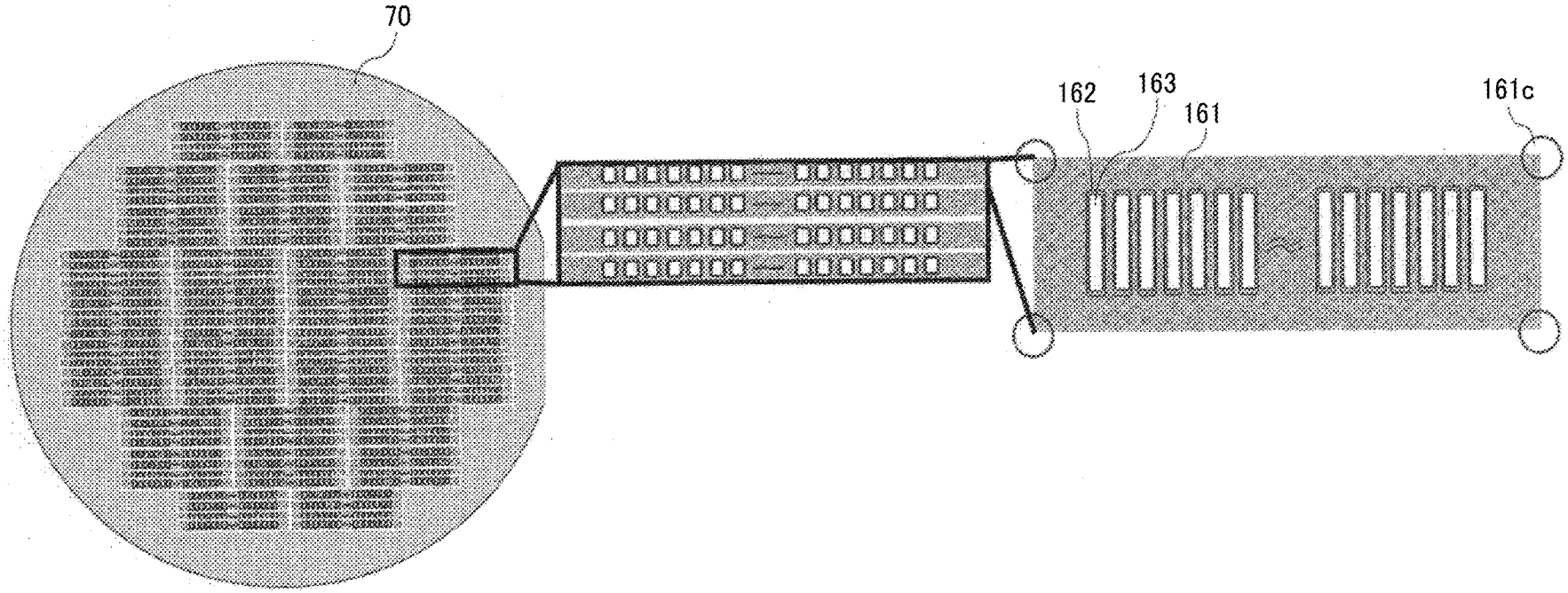
FIG. 35 is a conceptual view of a wafer in which a plurality of piezoelectric elements is formed.

In the resist stripping treatment, as illustrated in FIGS. 35, 36A, and 36B, the substrate 70 (wafer) on which an electrode and a piezoelectric body are formed is disposed in the substrate cassette 71, and the stripping liquid 73 is supplied to the substrate 70 from the stripping-liquid discharge nozzle 72 disposed outside the substrate 70. At this time, the substrate cassette 71 is rotated around a rotation shaft 74 such that the stripping liquid 73 spreads over the entire surface of the substrate 70 to perform the treatment. After this resist stripping treatment, peeling 75*p* of the common electrode 75 occurs as illustrated in the partially enlarged view of FIG. 36, which reduces a yield largely disadvantageously.

The peeling in the resist stripping treatment tends to occur particularly at a corner of the common electrode 75 (lower electrode 161) having a large pattern and located outside the substrate 70. A peeling interface is an interface between the diaphragm plate and the common electrode, and peeling occurs when the resist stripping liquid attacks a corner of the common electrode.

In contrast, in the present embodiment, the common electrode has a plurality of holes (also referred to as through holes) penetrating the common electrode. As a result, an internal stress in the common electrode can be relaxed, and therefore peeling of the common electrode can be suppressed. More specifically, when the resist stripping liquid attacks the common electrode, a stress acting in a surface direction inside the common electrode is relaxed, and the peeling of the common electrode can be suppressed.

As illustrated in FIGS. 5A, 5B, 6A, and 6B, the hole penetrating the common electrode is preferably circular when viewed from a lamination direction. Since the common electrode is often peeled off from a corner, the number of the corners can be reduced by forming the common electrode into a circular shape, and the common electrode can be less likely to be peeled off. Note that the view when viewed from a lamination direction corresponds to a plan view in the present embodiment.

In the present embodiment, when electro-mechanical transducer elements each including the first electrode, the electro-mechanical transducer film, and the second electrode are arranged in a plurality of rows on the diaphragm plate, electro-mechanical transducer elements of the plurality of electro-mechanical transducer elements constituting a row arranged on an end side on the diaphragm plate are preferably dummy electro-mechanical transducer elements. In the present embodiment, an electro-mechanical transducer film (piezoelectric body) to which no voltage is applied (that is, which does not contribute to discharge of droplets) is referred to as a dummy electro-mechanical transducer film (dummy piezoelectric body). An element in which an electrode is formed on the dummy electro-mechanical transducer film (dummy piezoelectric body) is referred to as a dummy electro-mechanical transducer element (dummy piezoelectric element).

A structure including a plurality of dummy piezoelectric bodies or a plurality of dummy piezoelectric elements is referred to as a dummy structure. In FIGS. 5A, 5B, 6A, and 6B, a dummy structure 170 is indicated by a broken line. In a through hole 200, an interface between the diaphragm plate and the common electrode is exposed. Therefore, guarding the through hole 200 with the dummy structure 170 can prevent the stripping liquid from directly attacking the interface as much as possible.

A location where the dummy structure 170 is disposed can be changed appropriately. For example, as illustrated in FIGS. 5A, 5B, 6A, and 6B, dummy structures 170 may be disposed near both ends of the common electrode (here, lower electrode 161) in a longitudinal direction thereof and at one end of the common electrode in a short direction thereof. The location where the dummy structure 170 is disposed is not limited thereto. The dummy structure 170 may be disposed at both ends of the common electrode in the longitudinal direction and at both ends of the common electrode in the short direction. In this case, an influence of the stripping liquid can be further reduced.

A difference between the dummy piezoelectric element and the discharge piezoelectric element that discharges droplets will be described. The dummy piezoelectric element has, for example, the same shape as the discharge piezoelectric element, but is a piezoelectric element in which no voltage is applied to the piezoelectric body, or the individual electrode is electrically floated and no voltage is applied to the piezoelectric body.

A method for forming a plurality of holes in the common electrode is not particularly limited. However, the plurality of holes is preferably formed during patterning of the common electrode. In this case, an increase in the number of steps can be prevented.

Figure 7A:
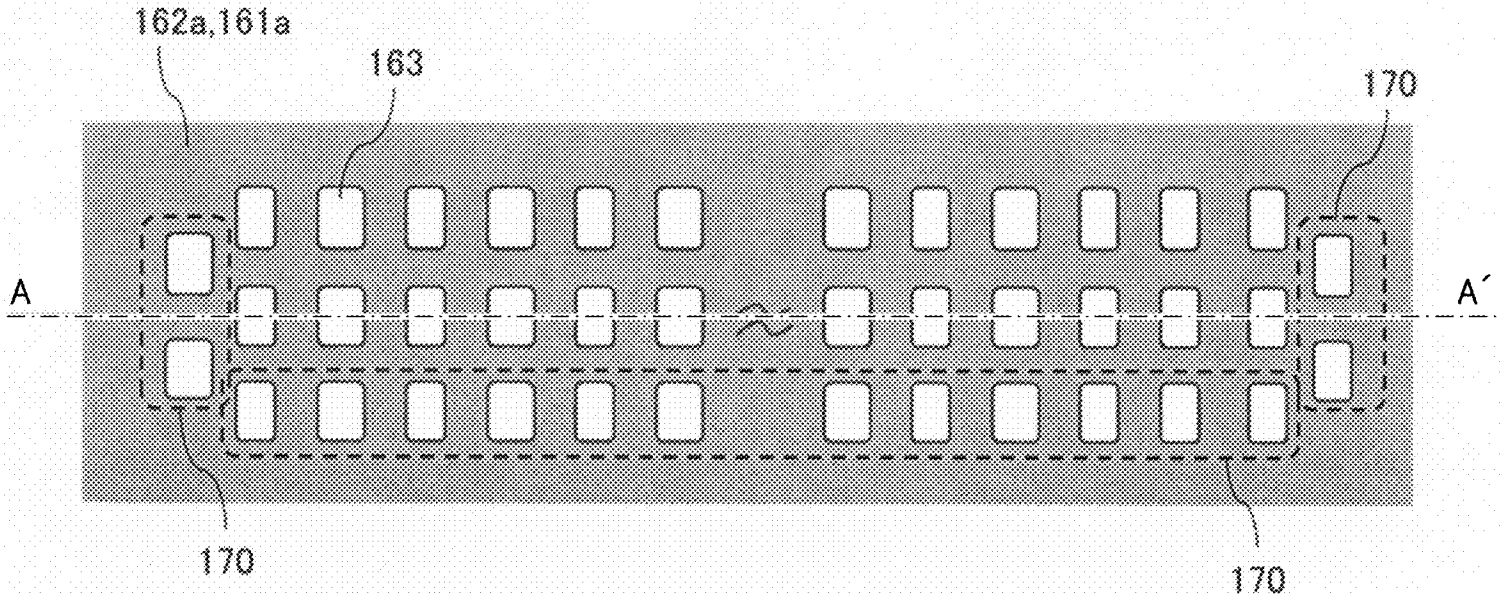
FIG. 7A is a plan view for explaining a step of manufacturing an electro-mechanical transducer.
Figure 7B:
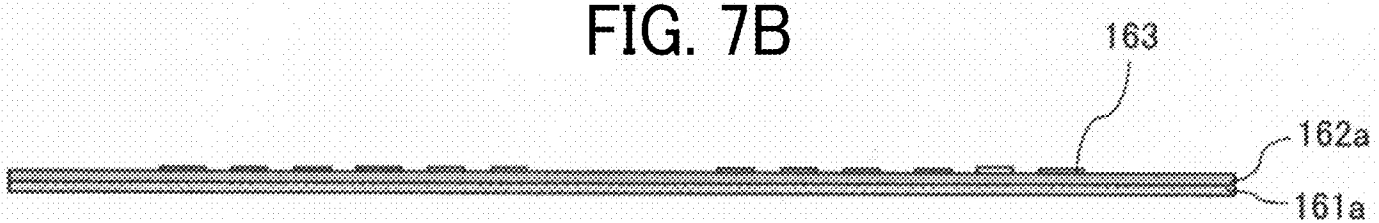
FIG. 7B is a cross-sectional view thereof cut along A-A'.

In FIGS. 5A and 5B, for example, the holes are manufactured as follows. First, a first electrode (common electrode), a piezoelectric film, and a second electrode (individual electrode) are formed on a diaphragm plate. FIGS. 7A and 7B illustrate examples of a plan view and a cross-sectional view when the second electrode (individual electrode) is patterned. In FIGS. 7A and 7B, since the first electrode and the piezoelectric film are not patterned, the first electrode and the piezoelectric film are denoted by reference numerals 161*a* and 162*a*, respectively.

Figure 8A:
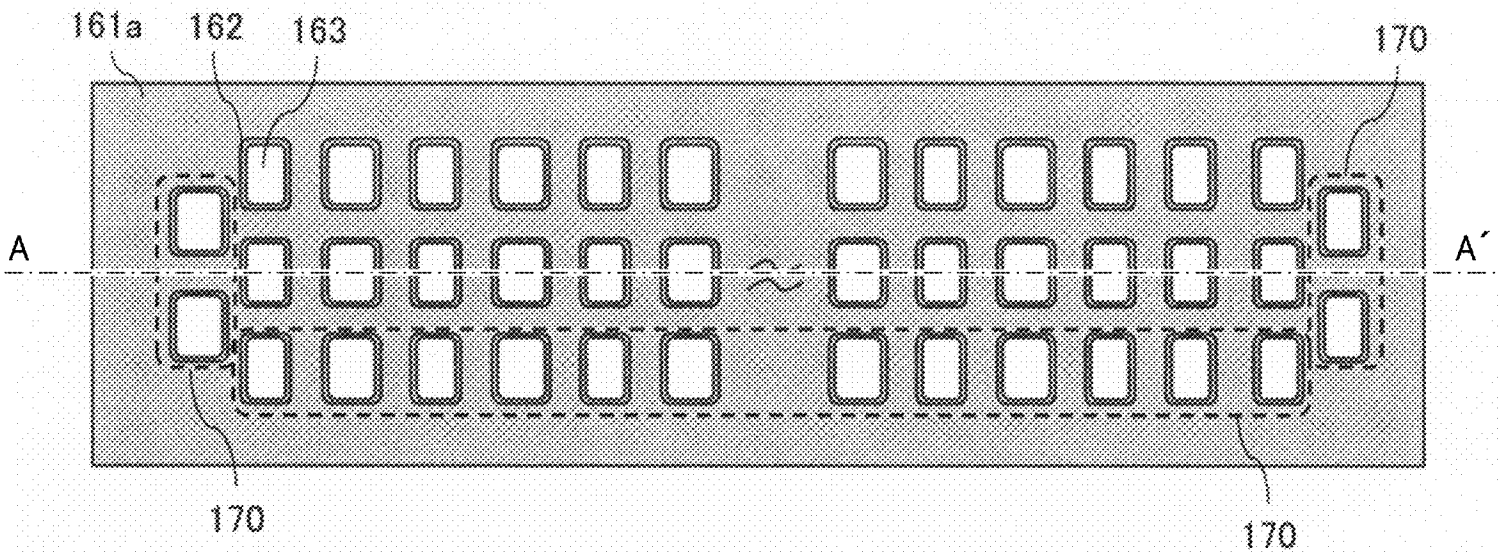
FIG. 8A is a plan view for explaining a step of manufacturing an electro-mechanical transducer.
Figure 8B:
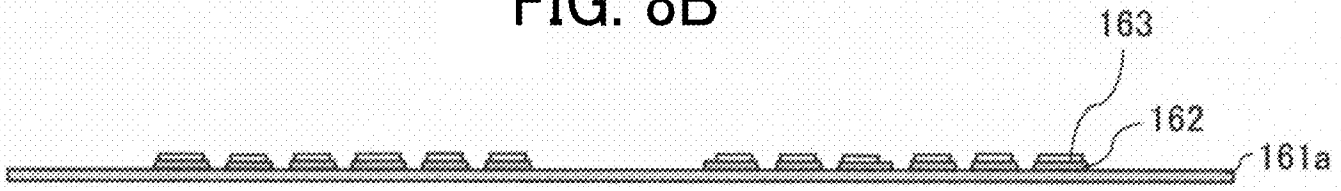
FIG. 8B is a cross-sectional view thereof cut along A-A'.

Next, the piezoelectric film is patterned. FIGS. 8A and 8B illustrate examples of a plan view and a cross-sectional view when the piezoelectric film is patterned.

Next, patterns of the first electrode (common electrode) and through holes are formed by photolithography. Next, a resist stripping treatment and an ashing treatment are performed to form through holes (FIGS. 5A and 5B).

In FIGS. 6A and 6B, for example, the holes are manufactured as follows. First, a first electrode (individual electrode) is patterned on a diaphragm plate, and a piezoelectric film is patterned. Next, patterns of the first electrode (common electrode) and through holes are formed by photolithography, and a resist stripping treatment and an ashing treatment are performed to form through holes.

Figure 9A:
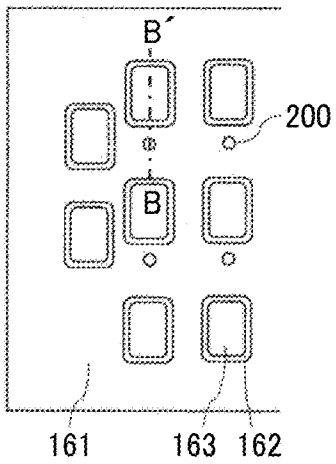
FIG. 9A is a plan view for explaining an example of a through hole.
Figure 9B:
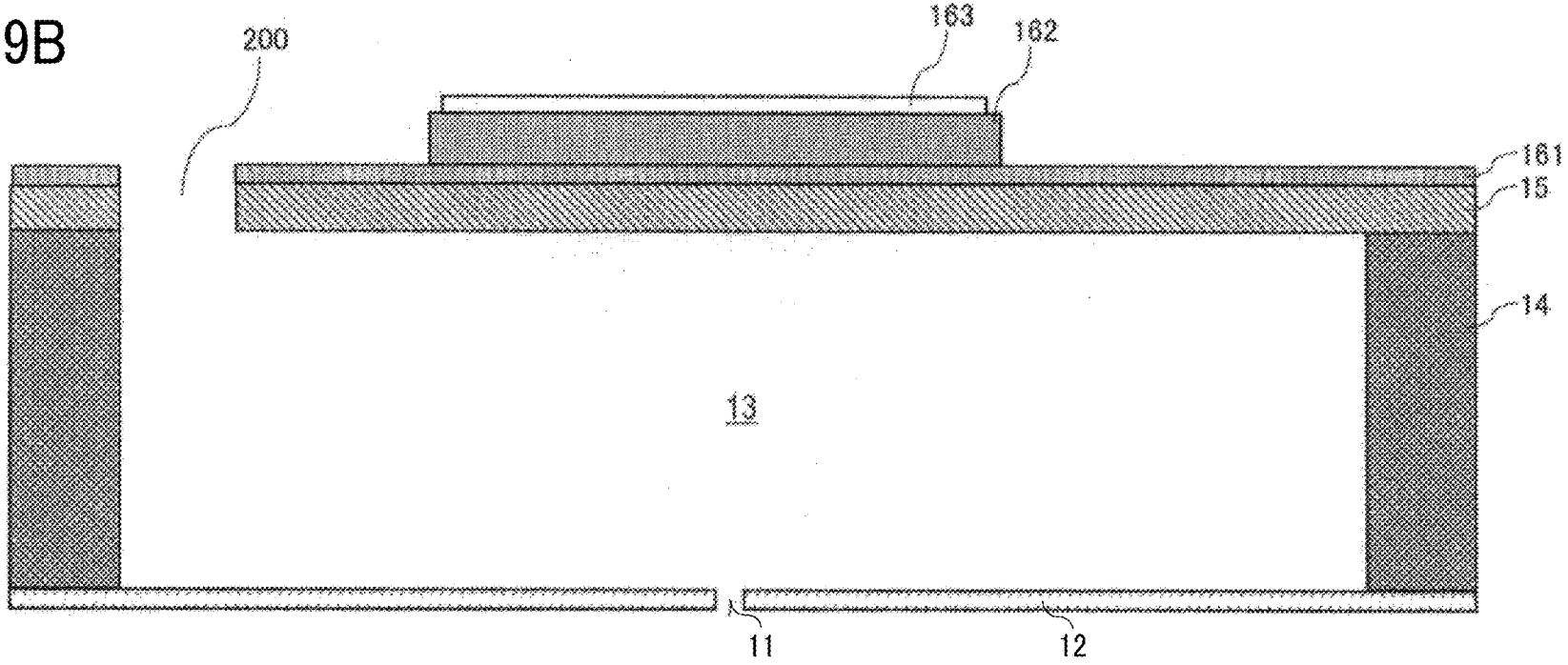
FIG. 9B is a cross-sectional view thereof cut along B-B'.

Next, the details of the through hole in the present embodiment will be further described. FIG. 9A illustrates a plan view of an example of the through hole, and FIG. 9B illustrates a cross-sectional view thereof cut along B-B'. FIGS. 9A and 9B illustrate an example in which the first electrode (lower electrode) is a common electrode and the second electrode (upper electrode) is an individual electrode. The through hole 200 illustrated in FIGS. 9A and 9B also serves as a supply hole (also referred to as a liquid supply hole) through which liquid (for example, ink) flows. The liquid flows through the through hole 200 to be supplied to the liquid chamber 13. Note that the cross section cut along B-B' corresponds to a cross section of the common electrode in a short direction thereof in a plan view.

Figure 10A:
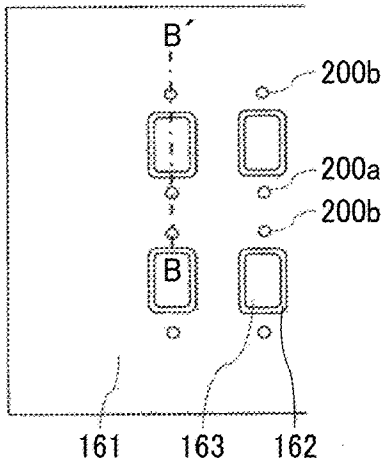
FIG. 10A is a plan view for explaining another example of a through hole.
Figure 10B:
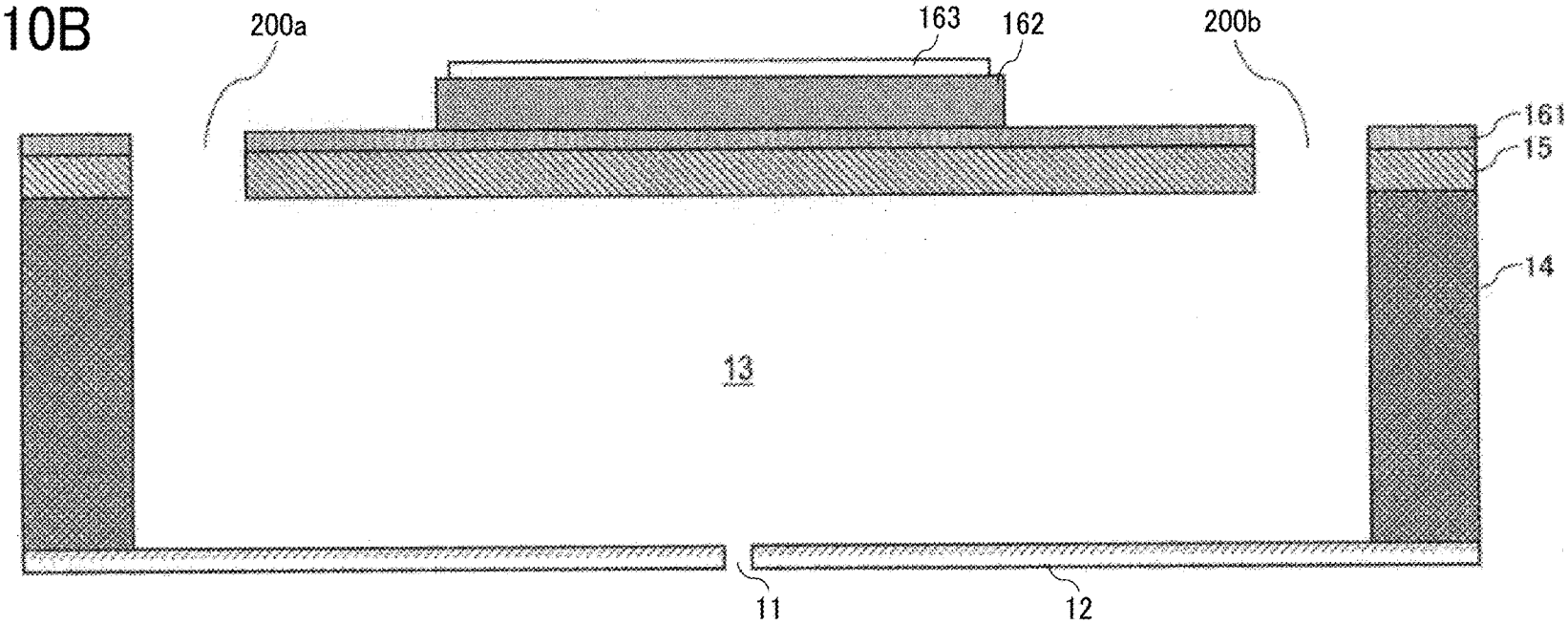
FIG. 10B is a cross-sectional view thereof cut along B-B'.

Other examples of the through hole will be described. FIG. 10A illustrates a plan view, and FIG. 10B illustrates a cross-sectional view thereof cut along B-B'. The through hole illustrated in FIGS. 10A and 10B also serves as a supply hole through which liquid flows. A through hole indicated by reference numeral 200*a* also serves as a liquid supply hole 200*a*, and a through hole indicated by reference numeral 200*b* also serves as a liquid collection hole 200*b*. In the present embodiment, the liquid supply hole 200*a* is used for supplying liquid to the liquid chamber 13, and the liquid collection hole 200*b* is used for collecting liquid from the liquid chamber 13. In this way, the through hole may be used as a liquid circulation path.

As described above, the through hole 200 in FIGS. 9A, 9B, 10A, and 10B also serves as a liquid supply hole for supplying liquid to the liquid chamber. Since the through hole also serves as a liquid supply hole or a liquid collection hole, a chip size can be reduced, and an apparatus can be downsized.

Figure 11A:
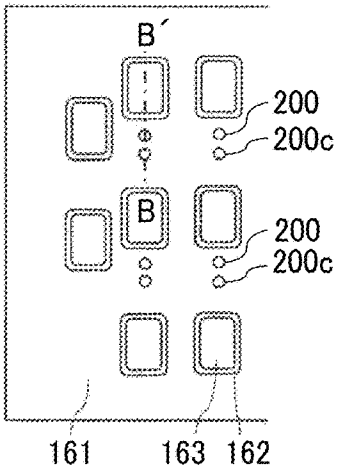
FIG. 11A is a plan view for explaining another example of a through hole.
Figure 11B:
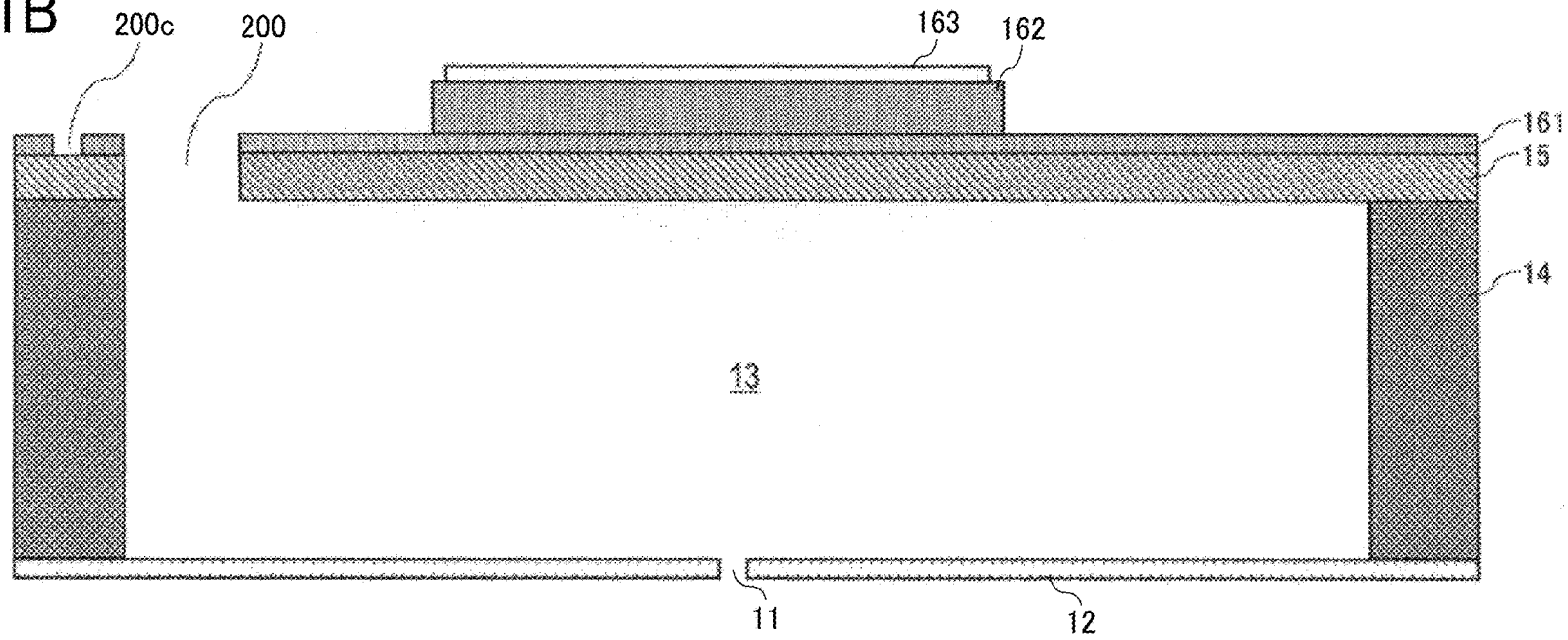
FIG. 11B is a cross-sectional view thereof cut along B-B'.

The present embodiment is not limited to the above configuration, but may be a configuration in which liquid does not flow into the through hole formed in the common electrode. A view for explaining this is illustrated in FIGS. 11A and 11B. FIG. 11A illustrates a plan view of an example of the through hole, and FIG. 11B illustrates a cross-sectional view thereof cut along B-B' similarly to FIGS. 9A, 9B, 10A, and 10B. FIGS. 11A and 11B illustrate the through hole 200 also serving as a liquid supply hole and a through hole 200*c* through which no liquid flows. The through hole 200*c* can be formed at an arbitrary location, and an arbitrary design can be performed for stress relaxation. That is, a through hole can be formed intensively at a location where a stress is concentrated to make the common electrode less likely to be peeled off.

In the present embodiment, the through holes are preferably formed at equal intervals. Note that the phrase "at equal intervals" refers to a case where the through holes are formed at equal intervals when viewed from a lamination direction, and a view when viewed from the lamination direction corresponds to a plan view or a top view in the present embodiment.

By the through holes formed at equal intervals, it is possible to prevent an internal stress of the common electrode from concentrating at a predetermined location, and to further suppress peeling of the common electrode.

Examples of formation "at equal intervals" include a case where the through holes 200 are formed as illustrated in FIGS. 5A and 6A. As illustrated in the drawings, the through holes 200 are formed at equal intervals in a longitudinal direction (left-right direction in the drawings) of the common electrode (lower electrode 161 or upper electrode 163) in the plan views. Even when not all the through holes are formed at equal intervals, the above effect is obtained, and the number (ratio) of the through holes formed at equal intervals is preferably large.

Figure 12A:
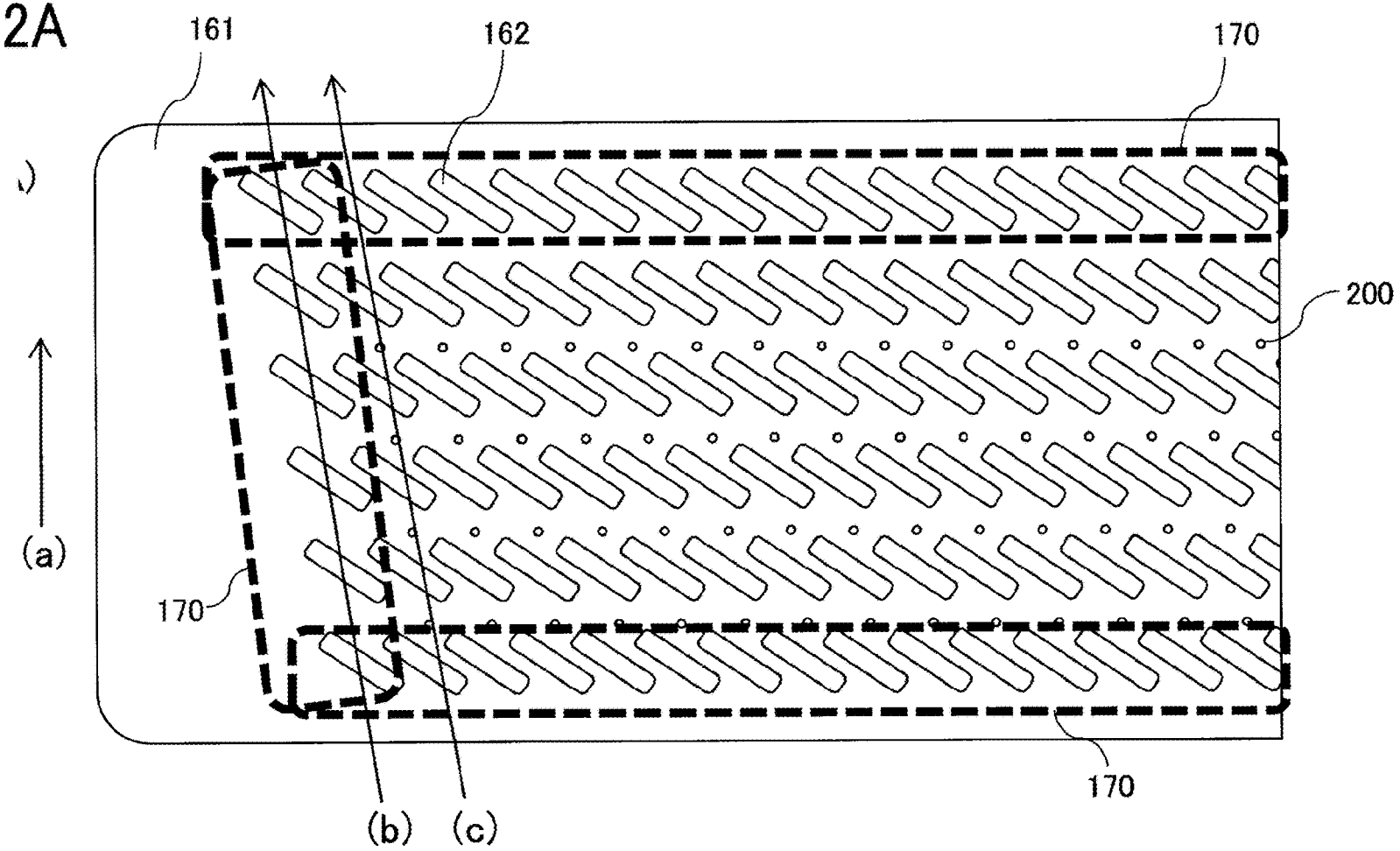
FIGS. 12A and 12B are plan views for explaining another example of a through hole.
Figure 12B:
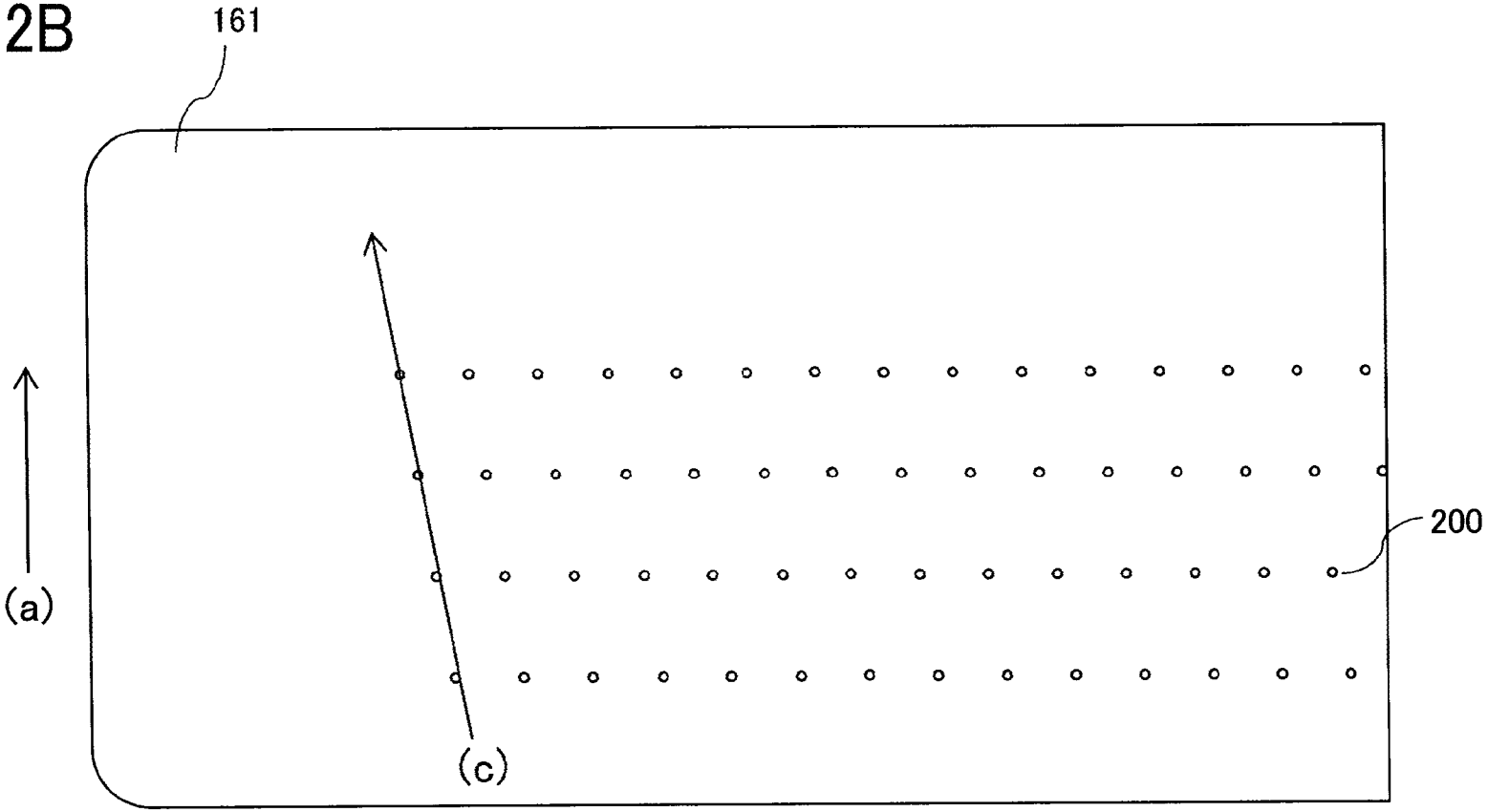

Another example of the case where the through holes are formed at equal intervals is illustrated in FIGS. 12A and 12B. FIG. 12A is a plan view for explaining arrangement of the electro-mechanical transducer films 162 and the through holes 200, and FIG. 12B illustrates the through holes 200 in FIG. 12A. Note that in the drawings, arrow (a) indicates a conveyance direction of a recording medium, arrow (b) indicates an arrangement direction of the electro-mechanical transducer films, and arrow (c) indicates an arrangement direction of the through holes. Here, an example in which the lower electrode 161 is a common electrode is illustrated, but an embodiment of the present disclosure is not limited to the example.

As illustrated in the drawings, the through holes 200 are formed at equal intervals in a longitudinal direction (left-right direction in the drawings) of the common electrode in the plan views. The through holes 200 are also formed at equal intervals in an arrangement direction of the through holes 200 (arrow (c) direction).

In FIGS. 12A and 12B, the arrangement direction of the electro-mechanical transducer films (arrow (b)) is inclined with respect to the conveyance direction (arrow (a)) of a recording medium. This improves resolution of an image. Similarly to the electro-mechanical transducer films, the arrangement direction of the through holes 200 (arrow (c)) is inclined with respect to the conveyance direction of a recording medium.

As described above, the plurality of electro-mechanical transducer elements (piezoelectric elements) constituting a row arranged on an end side on the diaphragm plate is preferably dummy electro-mechanical transducer elements. Also in the example illustrated here, as illustrated in FIG. 12A, the electro-mechanical transducer elements constituting a row arranged on an end side of the common electrode (here, lower electrode 161) in a longitudinal direction thereof (left-right direction in the drawings) and a row arranged on an end side of the common electrode in a short direction thereof (up-down direction in the drawings) in the plan view are the dummy structures 170. By forming the rows of the electro-mechanical transducer elements arranged in all directions with the dummy structures 170, an influence of the stripping liquid can be further reduced.

Figure 13:
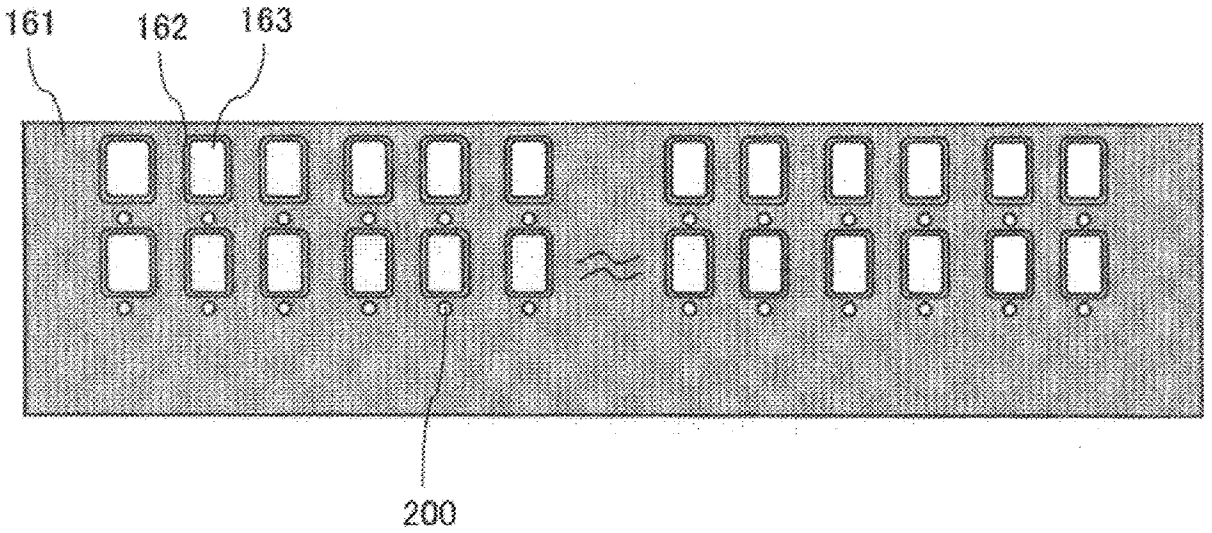
FIG. 13 is a plan view for explaining another example of a through hole.
Figure 14:
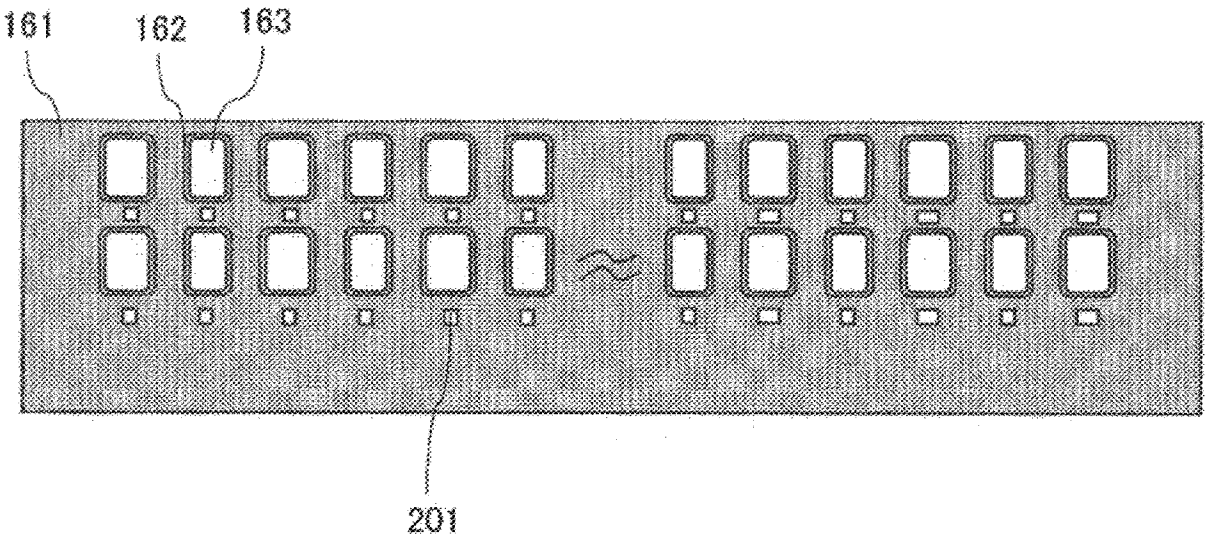
FIG. 14 is a plan view for explaining another example of a through hole.
Figure 15:
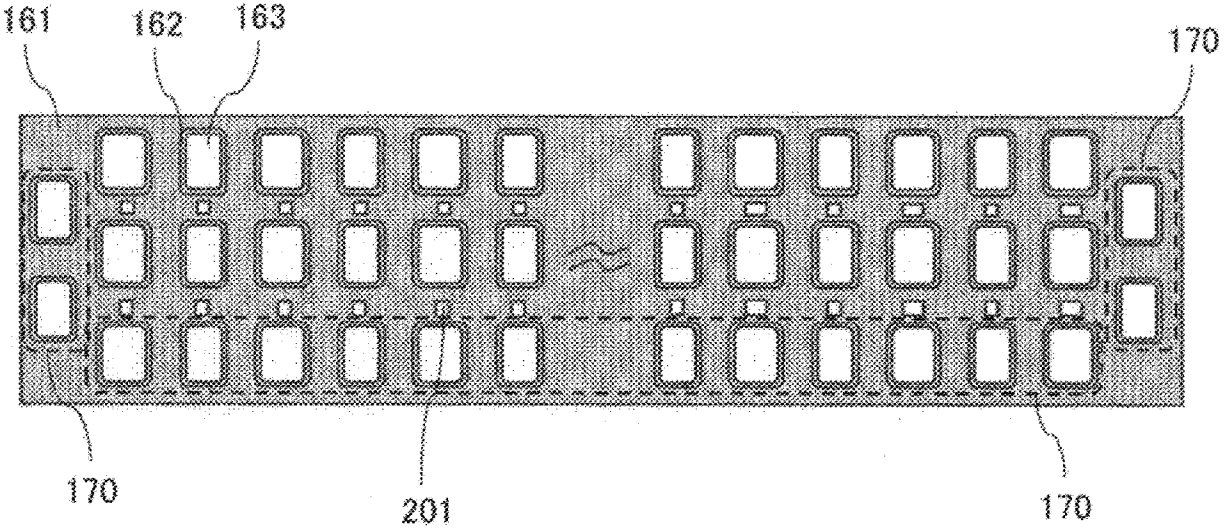
FIG. 15 is a plan view for explaining another example of a through hole.
Figure 16:
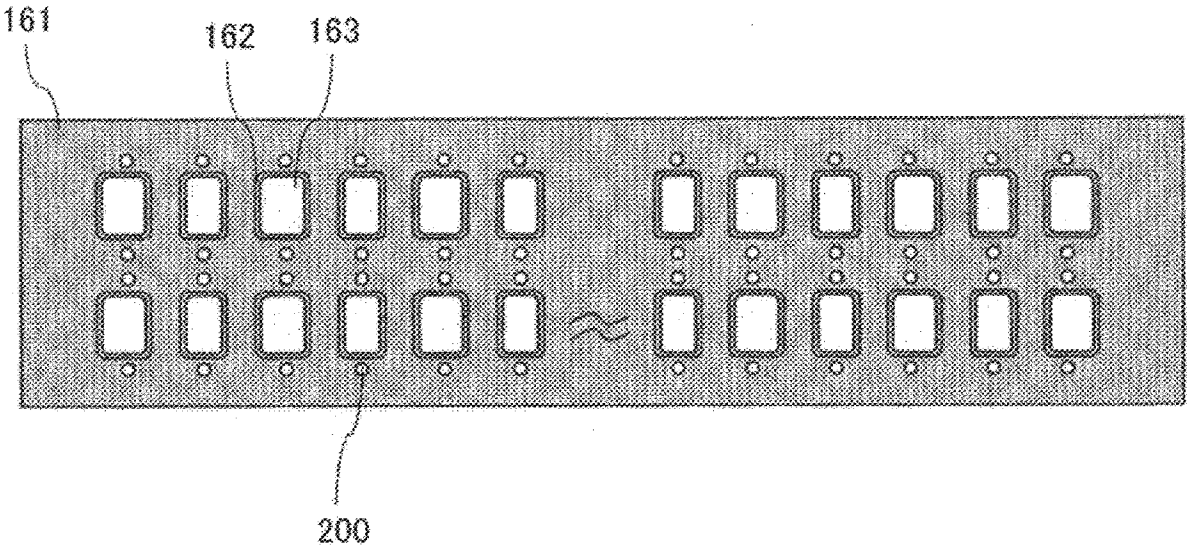
FIG. 16 is a plan view for explaining another example of a through hole.

Next, other embodiments of the common electrode will be described. FIGS. 13 to 16 are views for explaining other embodiments. FIG. 13 illustrates an example in which the dummy structure 170 is not disposed. FIG. 14 illustrates an example in which a rectangular through hole 201 is formed. FIG. 15 illustrates an example in which the shape of the through hole 201 is rectangular in the example illustrated in FIGS. 5A and 5B FIG. 16 illustrates an example in which the number of through holes 200 is increased in FIG. 13, and corresponds to FIG. 10A. Note that these examples are also included a case where the through holes are formed at equal intervals.

In the present embodiment, the number of holes penetrating the common electrode is preferably larger than the number of electro-mechanical transducer films. For example, in FIGS. 10A and 16, two through holes are formed for one electro-mechanical transducer film. By forming the through holes, peeling of the common electrode can be prevented. By setting the number of through holes to be larger than the number of electro-mechanical transducer films, the area of the common electrode is reduced to further suppress peeling.

According to the present embodiment, peeling of the common electrode can be suppressed, and a highly reliable electro-mechanical transducer can be obtained. The liquid discharge head according to the present embodiment includes the electro-mechanical transducer according to the present embodiment, and therefore has high reliability and excellent discharge characteristics.

In the method for manufacturing the electro-mechanical transducer according to the present embodiment, a through hole is formed when a common electrode is patterned, and therefore an increase in the number of steps can be prevented.

Other Embodiment of Liquid Discharge Head

Next, the liquid discharge head according to an embodiment of the present disclosure will be described with reference to FIGS. 17 to 24. Description of matters similar to those in the above embodiment will be omitted.

Figure 17:
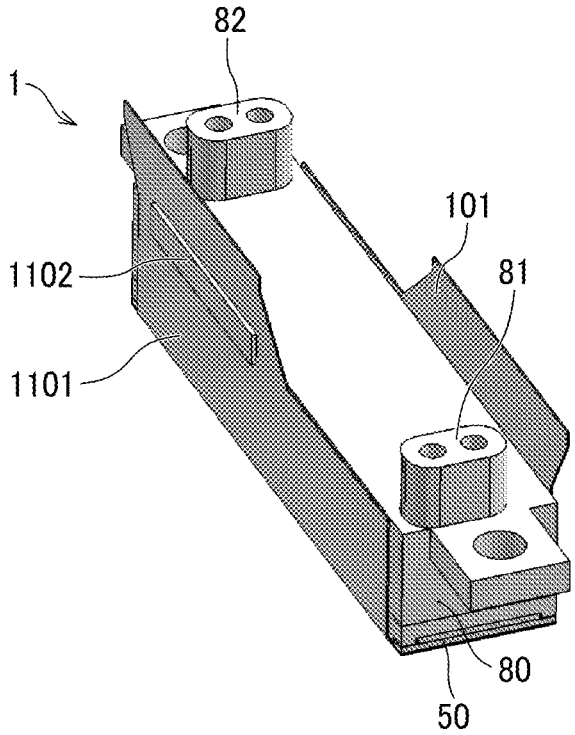
FIG. 17 is an external perspective explanatory view illustrating another example of a liquid discharge head according to an embodiment of the present invention.
Figure 18:
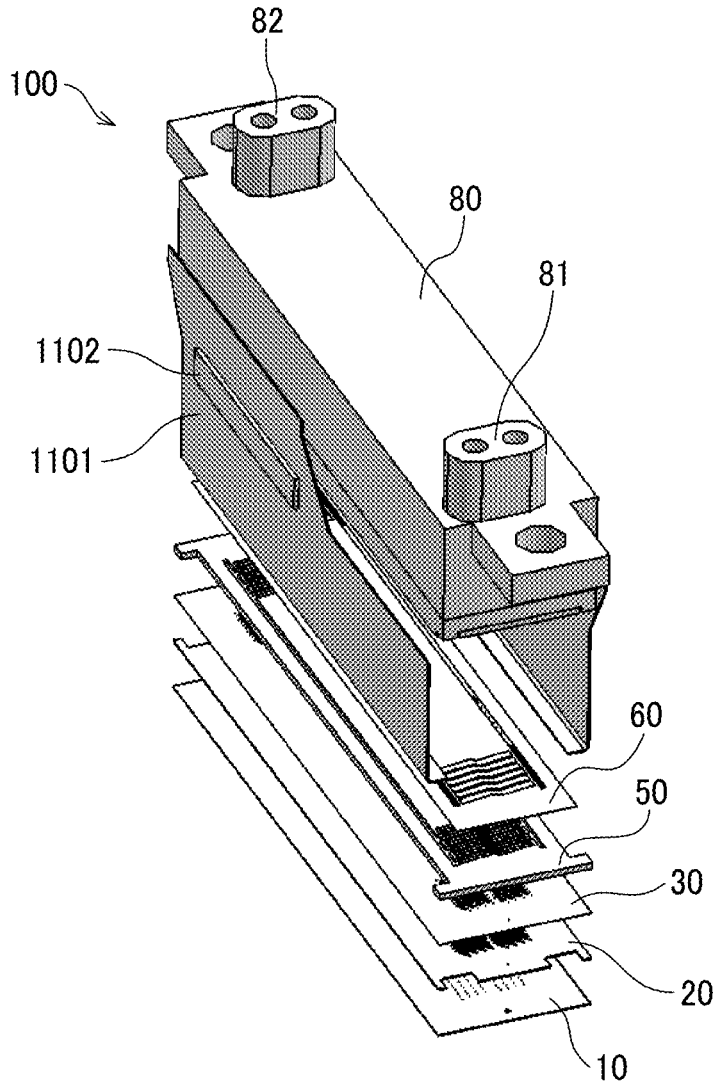
FIG. 18 is an exploded perspective explanatory view of the liquid discharge head.
Figure 19:
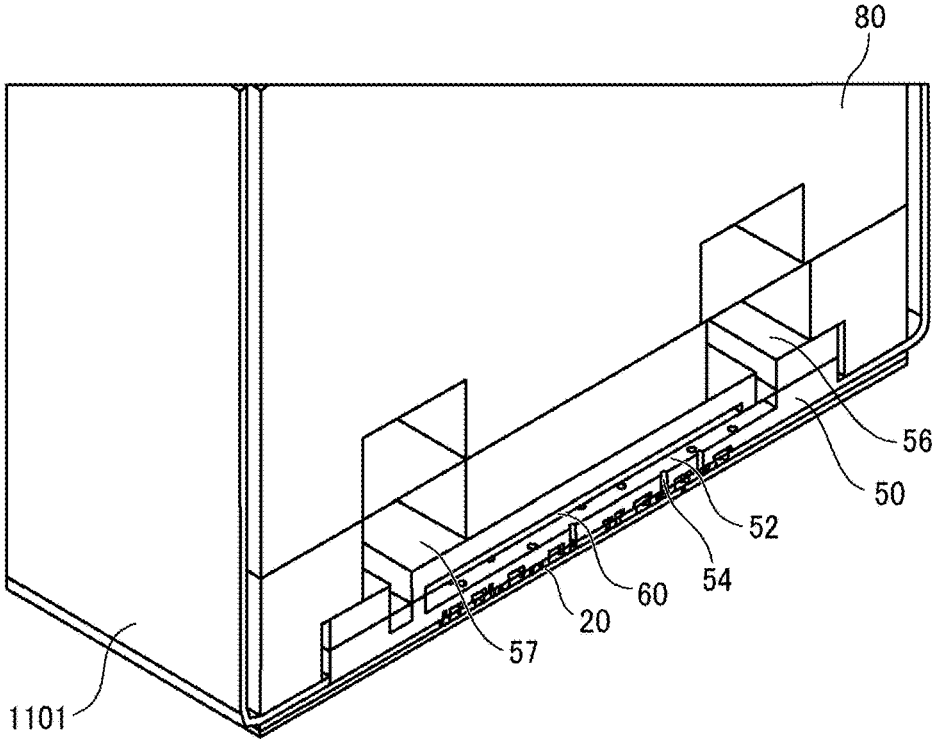
FIG. 19 is a cross-sectional perspective explanatory view of the liquid discharge head.
Figure 20:
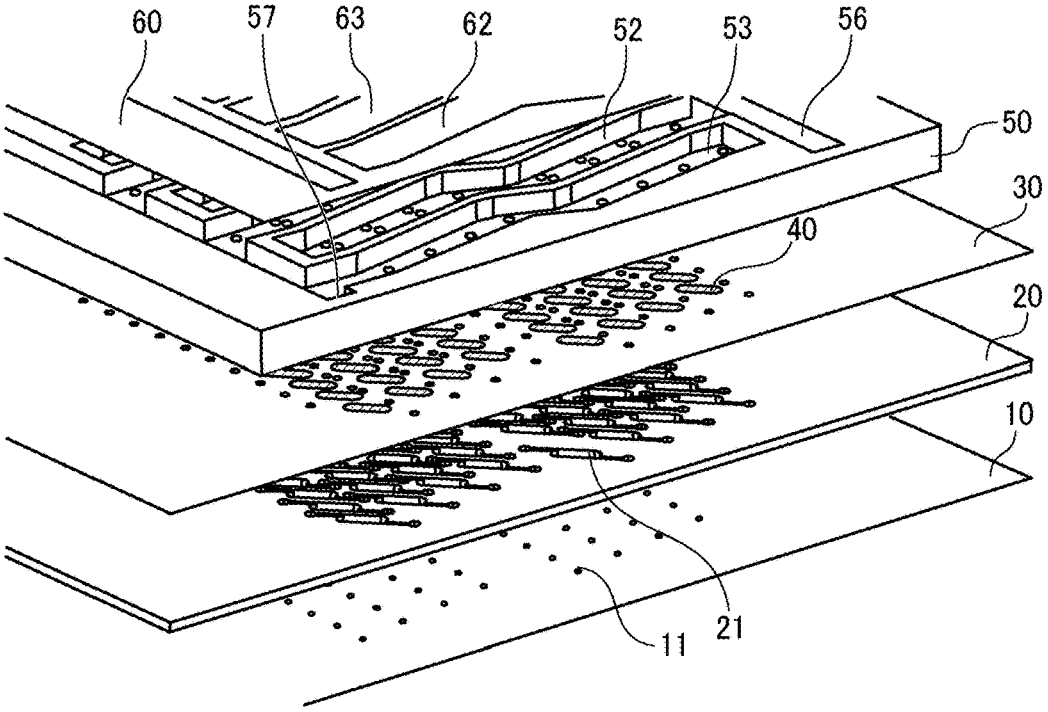
FIG. 20 is an exploded perspective explanatory view of the liquid discharge head, excluding a frame.
Figure 21:
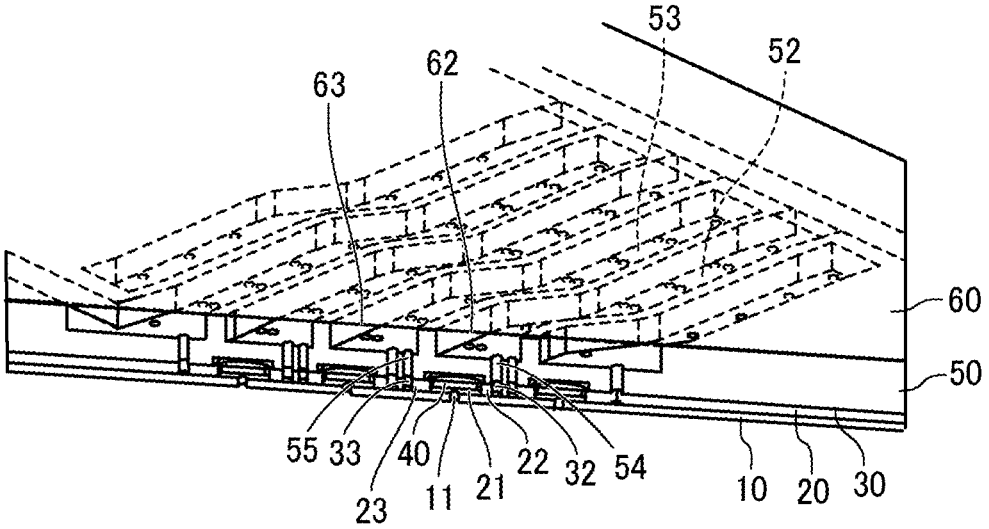
FIG. 21 is a cross-sectional perspective explanatory view of a channel portion of the liquid discharge head.
Figure 22:
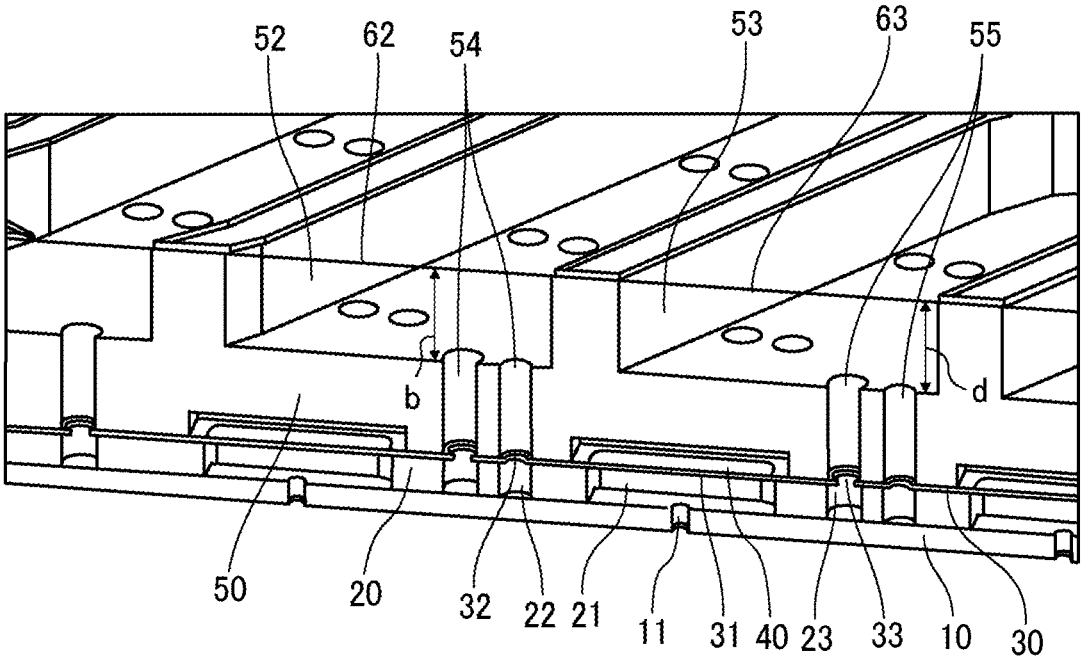
FIG. 22 is an enlarged cross-sectional perspective explanatory view of a channel portion of the liquid discharge head.
Figure 23:
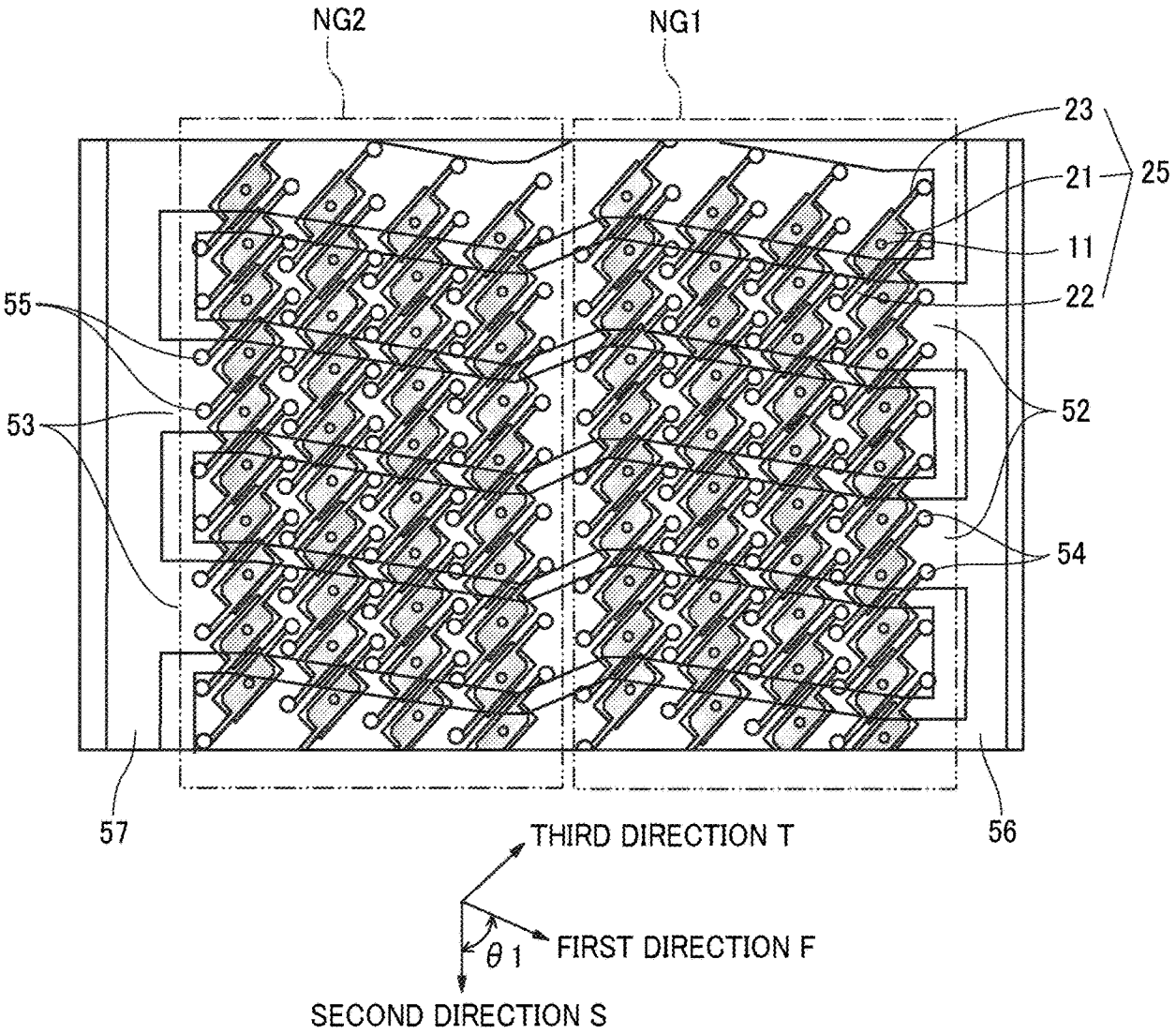
FIG. 23 is a plan explanatory view of a channel portion of the liquid discharge head.
Figure 24:
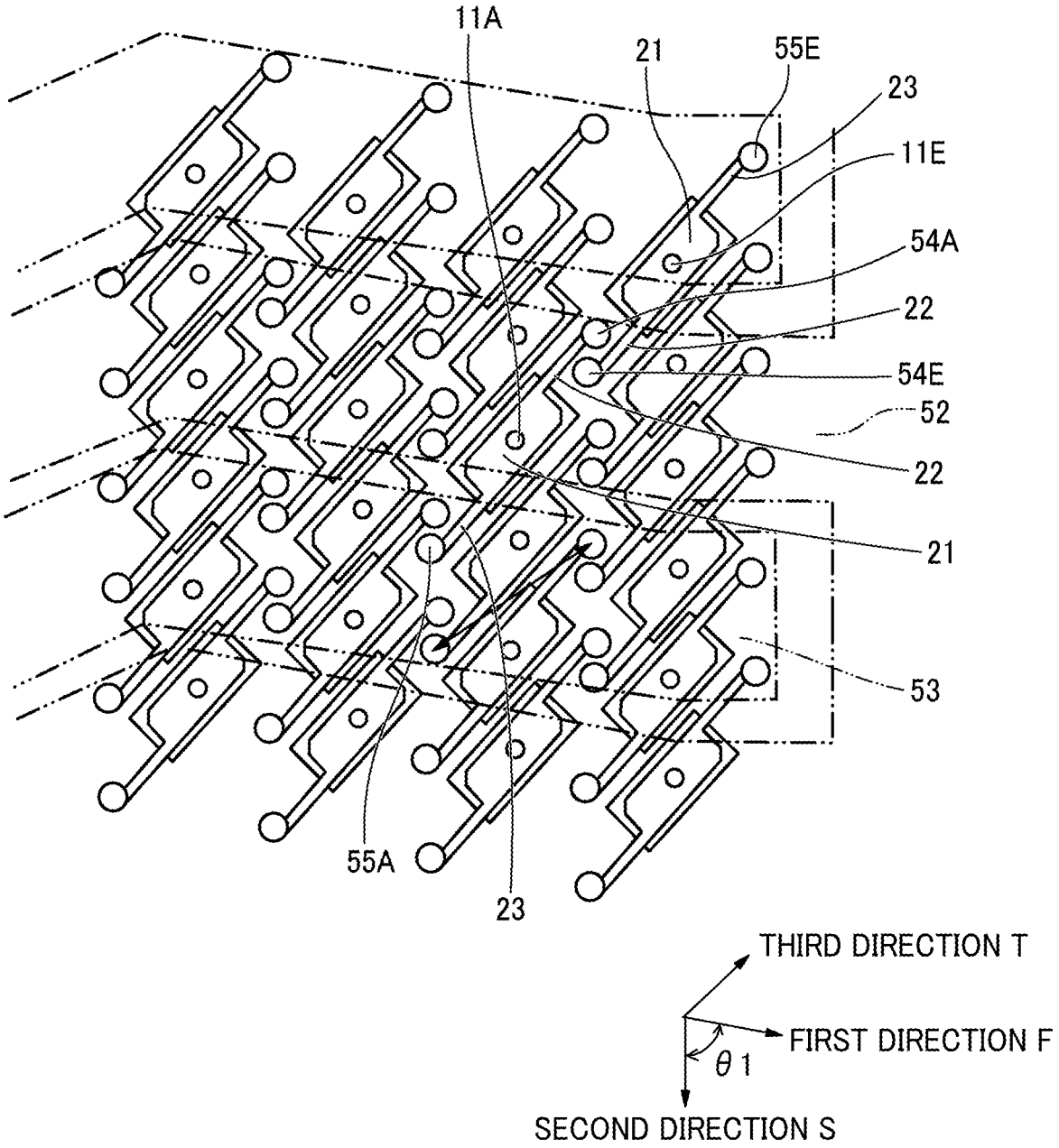
FIG. 24 is a plan explanatory view of a channel portion of the liquid discharge head.

FIG. 17 is a perspective explanatory view of an external appearance of the liquid discharge head according to the present embodiment. FIG. 18 is an exploded perspective explanatory view of the liquid discharge head. FIG. 19 is a cross-sectional perspective explanatory view of the liquid discharge head. FIG. 20 is an exploded perspective explanatory view of the liquid discharge head, excluding a frame member. FIG. 21 is a cross-sectional perspective explanatory view of a channel portion of the liquid discharge head. FIG. 22 is an enlarged cross-sectional perspective explanatory view of a channel portion of the liquid discharge head. FIGS. 23 and 24 are plan explanatory views of a channel portion of the liquid discharge head.

A liquid discharge head 1 includes a nozzle plate 10, a channel plate (individual channel member) 20, a diaphragm member 30, a common channel member 50, a damper member 60, a frame member 80, a board (flexible wiring board) 1101 having a drive circuit 1102 mounted thereon, and the like.

The nozzle plate 10 includes a plurality of nozzles 11 that discharges liquid. The plurality of nozzles 11 is two-dimensionally arranged in a matrix and arranged in three directions of a first direction F, a second direction S, and a third direction T as illustrated in FIGS. 23 and 24.

The individual channel member 20 forms a plurality of pressure chambers (individual liquid chambers) 21 respectively communicating with the plurality of nozzles 11, a plurality of individual supply channels 22 respectively communicating with the plurality of pressure chambers 21, and a plurality of individual collection channels 23 respectively communicating with the plurality of pressure chambers 21. One of the pressure chambers 21, one of the individual supply channels 22 communicating with the pressure chamber 21, and one of the individual collection channels 23 communicating with the pressure chamber 21 are collectively referred to as an individual channel 25.

The diaphragm member 30 forms a diaphragm plate 31 which is a deformable wall surface of the pressure chamber 21, and a piezoelectric element 40 is integrally disposed on the diaphragm plate 31. On the diaphragm member 30, a supply side opening 32 communicating with the individual supply channel 22 and a collection side opening 33 communicating with the individual collection channel 23 are formed. The piezoelectric element 40 is a pressure generator that deforms the diaphragm plate 31 to pressurize liquid in the pressure chamber 21.

Note that the individual channel member 20 and the diaphragm member 30 are not limited to being separate members as members. For example, the individual channel member 20 and the diaphragm member 30 can be formed integrally with the same member using a silicon on insulator (SOI) substrate. That is, an SOI substrate formed on a silicon substrate in order of a silicon oxide film, a silicon layer, and a silicon oxide film is used, the silicon substrate is used as the individual channel member 20, and the silicon oxide film, the silicon layer, and the silicon oxide film can form the diaphragm plate 31. In this configuration, the layer configuration of the silicon oxide film, the silicon layer, and the silicon oxide film in the SOI substrate serves as the diaphragm member 30. As described above, the diaphragm member 30 includes a member containing a film-formed material on a surface of the individual channel member 20.

The common channel member 50 forms a plurality of common supply channel branches 52 communicating with two or more of the individual supply channels 22 and a plurality of common collection channel branches 53 communicating with two or more of the individual collection channels 23 alternately so as to be adjacent to each other in the second direction S of the nozzles 11.

In the common channel member 50, a through hole serving as a supply port 54 for communicating the supply side opening 32 of the individual supply channel 22 with the common supply channel branch 52 and a through hole serving as a collection port 55 for communicating the collection side opening 33 of the individual collection channel 23 with the common collection channel branch 53 are formed. In the present embodiment, the through holes penetrate the common electrode in which the supply side opening 32 and the collection side opening 33 are formed.

The common channel member 50 forms one or more common supply channel mainstreams 56 communicating with the plurality of common supply channel branches 52 and one or more common collection channel mainstreams 57 communicating with the plurality of common collection channel branches 53.

The damper member 60 includes a supply side damper 62 facing (opposing to) the supply port 54 of the common supply channel branch 52 and a collection side damper 63 facing (opposing to) the collection port 55 of the common collection channel branch 53.

Here, the common supply channel branch 52 and the common collection channel branch 53 are alternately arranged in the same common channel member 50 to form grooves, and the grooves are sealed with the supply side damper 62 or the collection side damper 63 of the damper member 60. Note that a damper material of the damper member 60 is preferably a metal thin film or an inorganic thin film resistant to an organic solvent. The thickness of the damper member 60 in a portion of the supply side damper 62 or the collection side damper 63 is preferably 10 μm or less.

First, with reference to FIGS. 23 and 24, the plurality of nozzles 11 is two-dimensionally arranged in a matrix and arranged in three directions of the first direction F, the second direction S, and the third direction T. As illustrated in FIG. 23, a group of the nozzles 11 two-dimensionally arranged in a matrix is referred to as a nozzle group NG (NG1 and NG2).

In one nozzle group NG, when arrangement of the plurality of nozzles 11 in the second direction S is referred to as a nozzle row, the first direction F is a direction in which the nozzle rows are arranged at a predetermined inclination angle θ1 with respect to an arrangement direction of the nozzles 11. The common supply channel branch 52 and the common collection channel branch 53 extend in the first direction F. Therefore, the longitudinal direction of the common supply channel branch 52 and the common collection channel branch 53 is along the first direction F.

In one nozzle group NG, the second direction S is a direction in which the nearest neighboring nozzles 11 are arranged (nozzle arrangement direction), and is a direction intersecting with the first direction F at the angle θ1 if the first direction F is used as a reference. The common supply channel branch 52 and the common collection channel branch 53 are alternately arranged in the second direction S.

In one nozzle group NG, the third direction T is a direction intersecting with the first direction F and the second direction S. In the present embodiment, the individual channel 25 including the individual supply channel 22, the pressure chamber 21, and the individual collection channel 23 is disposed in the third direction.

Here, the individual channel 25 including the individual supply channel 22, the pressure chamber 21, and the individual collection channel 23 is two-fold rotationally symmetrical with respect to an axis of the nozzle 11 (central axis in a liquid discharge direction).

By making the individual channel 25 two-fold rotationally symmetrical, in the example illustrated in FIG. 24, for example, like a relationship between an individual channel 25 communicating with a nozzle 11A and an individual channel 25 communicating with a nozzle 11E, the individual channel 25 can be reversed and disposed with respect to the nozzles 11A and 11E adjacent to each other in a direction (third direction T) parallel to the flow of liquid in the individual channel 25.

That is, with respect to the supply port 54A communicating with an individual liquid chamber 21 of the nozzle 11A and the supply port 54E communicating with an individual liquid chamber 21 of the nozzle 11E, disposed in the same common supply channel branch 52, the individual liquid chambers 21 can be reversed and disposed.

As a result, the mounting density of the individual liquid chambers 21 (nozzles 11) can be increased without being restricted by arrangement of the common supply channel branch 52, and the head can be downsized.

Two nozzles 11 respectively communicating with the two nearest neighboring supply ports 54 in the same common supply channel branch 52, for example, in the example of FIG. 24, the nozzle 11A coupled to the supply port 54A and the nozzle 11E coupled to the supply port 54E communicate with different common collection channel branches 53 through collection ports 55A and 55E.

Note that the individual channels 25 are arranged in a translational symmetrical form (not reversed) with respect to the direction (first direction F) of the flow of liquid in the common supply channel branch 52 and the common collection channel branch 53.

Liquid Discharge Device and Liquid Discharge Apparatus

The liquid discharge device according to an embodiment of the present disclosure includes a liquid discharge head. Examples of the liquid discharge device include a liquid discharge device formed by integrating at least one of a head tank that stores liquid to be supplied to a liquid discharge head, a carriage having the liquid discharge head mounted thereon, a supply mechanism that supplies liquid to the liquid discharge head, a maintenance recovery device that performs maintenance and recovery of the liquid discharge head, and a main-scanning moving mechanism that moves the liquid discharge head in a main scanning direction with the liquid discharge head. The liquid discharge apparatus according to an embodiment of the present disclosure includes the liquid discharge head according to an embodiment of the present disclosure or the liquid discharge device according to an embodiment of the present disclosure.

Figure 25:
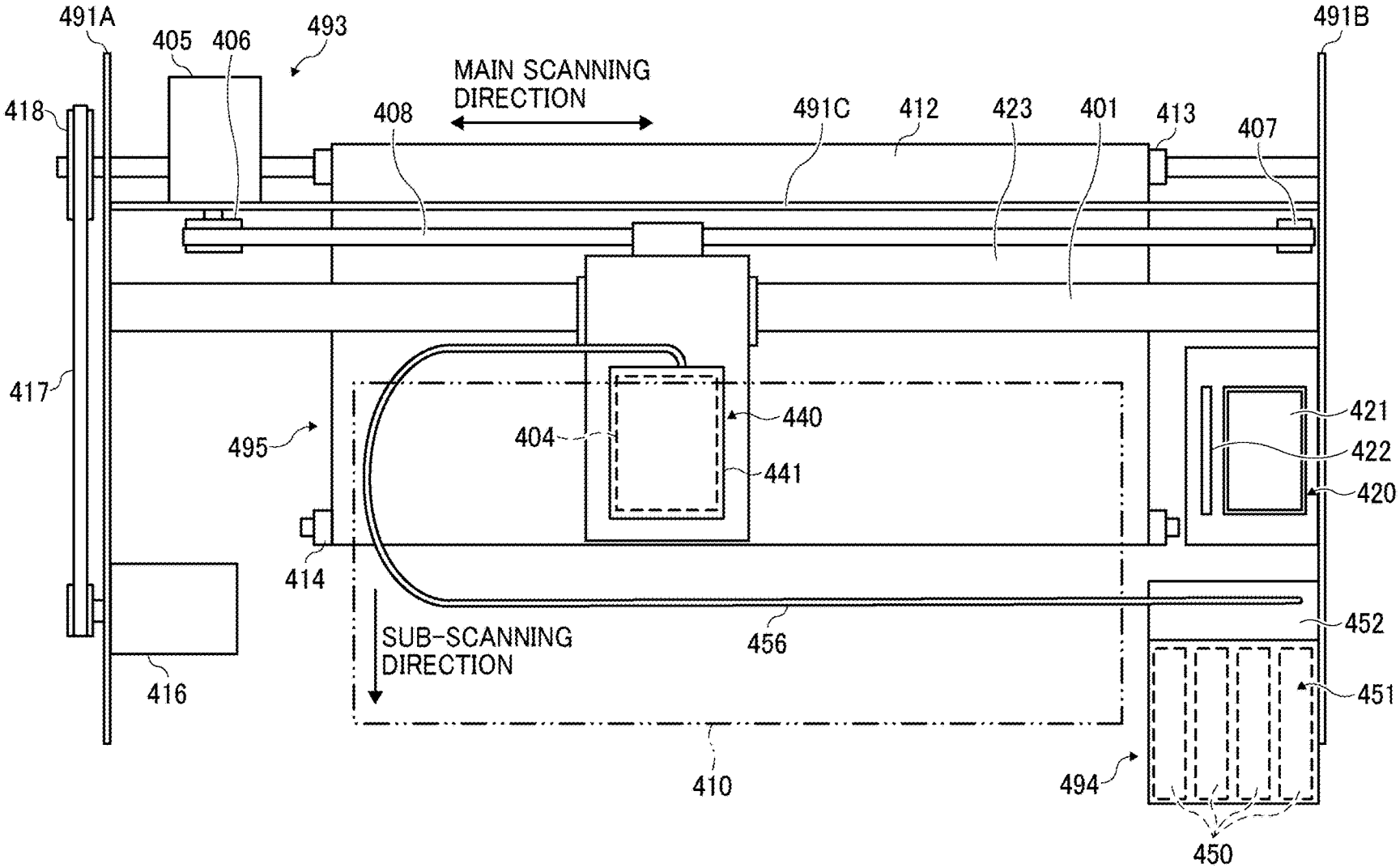
FIG. 25 is a schematic view illustrating an example of a liquid discharge device according to an embodiment of the present invention.
Figure 26:
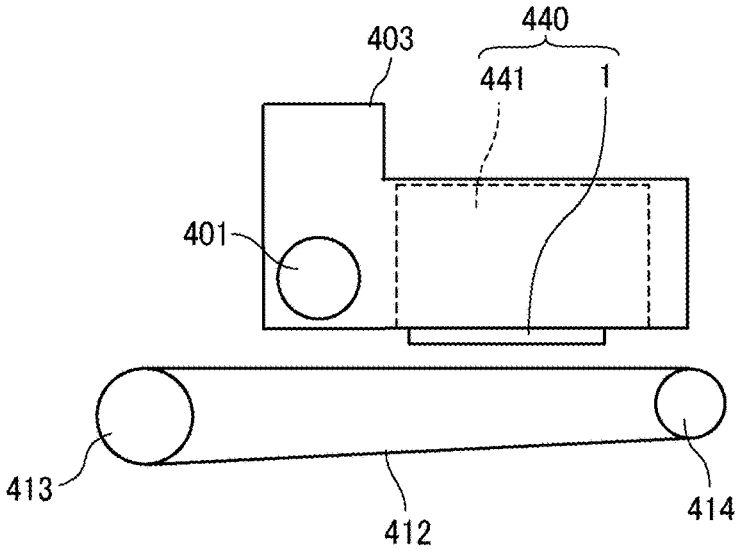
FIG. 26 is a schematic view illustrating another example of a liquid discharge device according to an embodiment of the present invention.

An example of the liquid discharge apparatus according to an embodiment of the present disclosure will be described with reference to FIGS. 25 and 26. FIG. 25 is a plan explanatory view of a main part of the liquid discharge apparatus. FIG. 26 is a side explanatory view of a main part of the liquid discharge apparatus.

This apparatus is a serial type apparatus, and a carriage 403 reciprocates in a main scanning direction by a main-scanning moving mechanism 493. The main-scanning moving mechanism 493 includes a guide member 401, a main scanning motor 405, a timing belt 408, and the like. The guide member 401 is stretched between left and right side plates 491A and 491B to movably hold the carriage 403. The main scanning motor 405 reciprocates the carriage 403 in the main scanning direction via the timing belt 408 stretched between a driving roller 406 and a driven roller 407.

The carriage 403 has a liquid discharge device 440 formed by integrating the liquid discharge head 404 according to an embodiment of the present disclosure with a head tank 441 mounted thereon. The liquid discharge head 404 of the liquid discharge device 440 discharges liquid of colors of, for example, yellow (Y), cyan (C), magenta (M), and black (K). The liquid discharge head 404 arranges nozzle rows including the plurality of nozzles 11 in a sub-scanning direction orthogonal to the main scanning direction with a discharge direction downward.

Liquid stored in a liquid cartridge 450 is supplied to the head tank 441 by a supply mechanism 494 for supplying liquid stored outside the liquid discharge head 404 to the liquid discharge head 404.

The supply mechanism 494 includes a cartridge holder 451 which is a filling unit for mounting the liquid cartridge 450, a tube 456, a liquid feed unit 452 including a liquid feed pump, and the like. The liquid cartridge 450 is detachably attached to the cartridge holder 451. Liquid is sent from the liquid cartridge 450 to the head tank 441 via the tube 456 by the liquid feed unit 452.

This apparatus includes a conveyance mechanism 495 for conveying a sheet of paper 410. The conveyance mechanism 495 includes a conveyance belt 412 as a conveying means and a sub-scanning motor 416 for driving the conveyance belt 412.

The conveyance belt 412 attracts the sheet 410 and conveys the sheet 410 at a position facing the liquid discharge head 404. The conveyance belt 412 is an endless belt, and is bridged between a conveyance roller 413 and a tension roller 414. Attraction can be performed by electrostatic attraction, air suction, or the like.

The conveyance belt 412 is rotated in the sub-scanning direction by rotation of the conveyance roller 413 through the timing belt 417 and a timing pulley 418 by the sub-scanning motor 416.

Furthermore, on one side of the carriage 403 in the main scanning direction, a maintenance recovery device 420 that maintains and recovers the liquid discharge head 404 is disposed on a side of the conveyance belt 412.

The maintenance recovery device 420 includes, for example, a cap 421 that caps a nozzle surface (surface on which the nozzles 11 are formed) of the liquid discharge head 404 and a wiper 422 that wipes the nozzle surface.

The main-scanning moving mechanism 493, the supply mechanism 494, the maintenance recovery device 420, and the conveyance mechanism 495 are attached to a housing including the side plates 491A and 491B and a back plate 491C.

In this apparatus having such a configuration, the sheet 410 is fed onto the conveyance belt 412, attracted, and conveyed in the sub-scanning direction by rotation of the conveyance belt 412.

Therefore, the liquid discharge head 404 is driven in accordance with an image signal while the carriage 403 is moved in the main scanning direction to discharge liquid onto the sheet 410 being stopped, thus forming an image.

In this way, this apparatus includes the liquid discharge head according to an embodiment of the present disclosure, and therefore can stably form a high-quality image.

Figure 27:
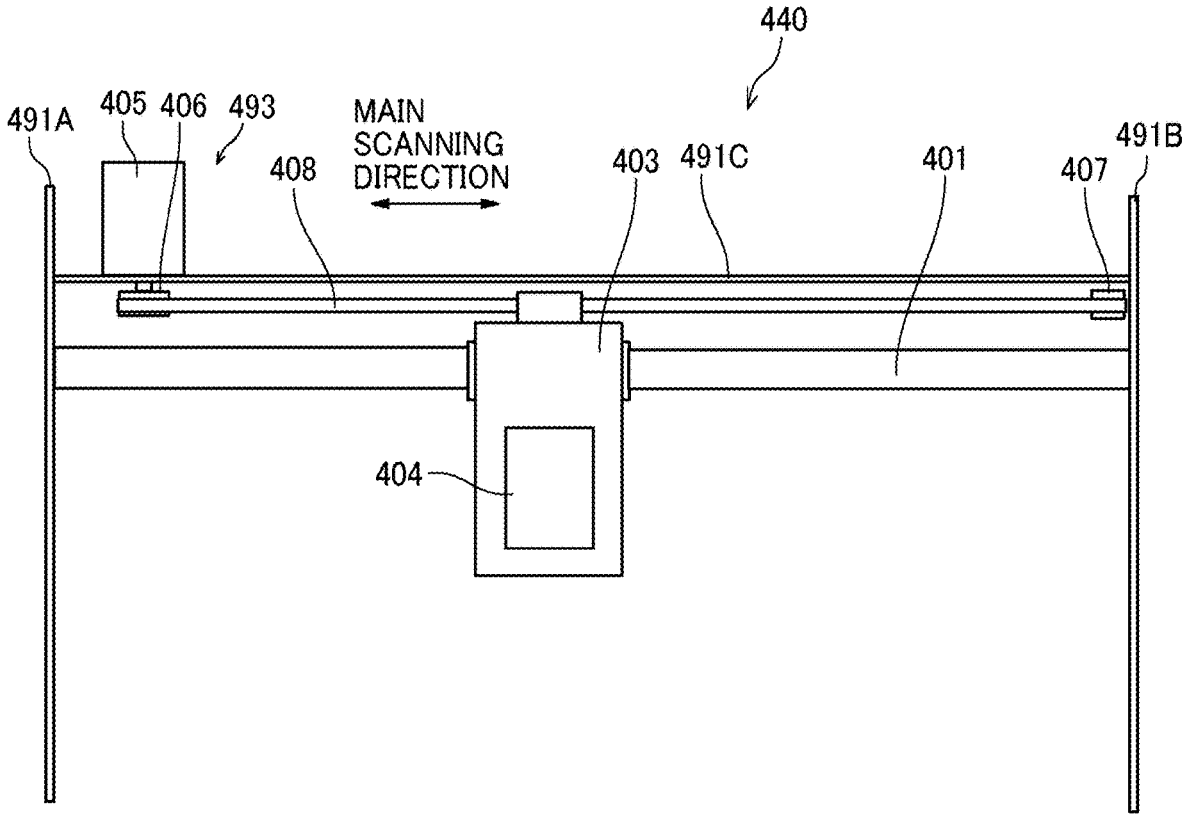
FIG. 27 is a schematic view illustrating another example of a liquid discharge device according to an embodiment of the present invention.

Next, another example of the liquid discharge device according to an embodiment of the present disclosure will be described with reference to FIG. 27. FIG. 27 is a plan explanatory view of a main part of the device.

This liquid discharge device includes a housing portion including the side plates 491A and 491B and the back plate 491C, the main-scanning moving mechanism 493, the carriage 403, and the liquid discharge head 404 out of the members constituting the liquid discharge apparatus.

Note that it is also possible to form a liquid discharge device having at least either one of the above-described maintenance recovery device 420 and supply mechanism 494 further attached to, for example, the side plate 491B of this liquid discharge device.

Figure 28:
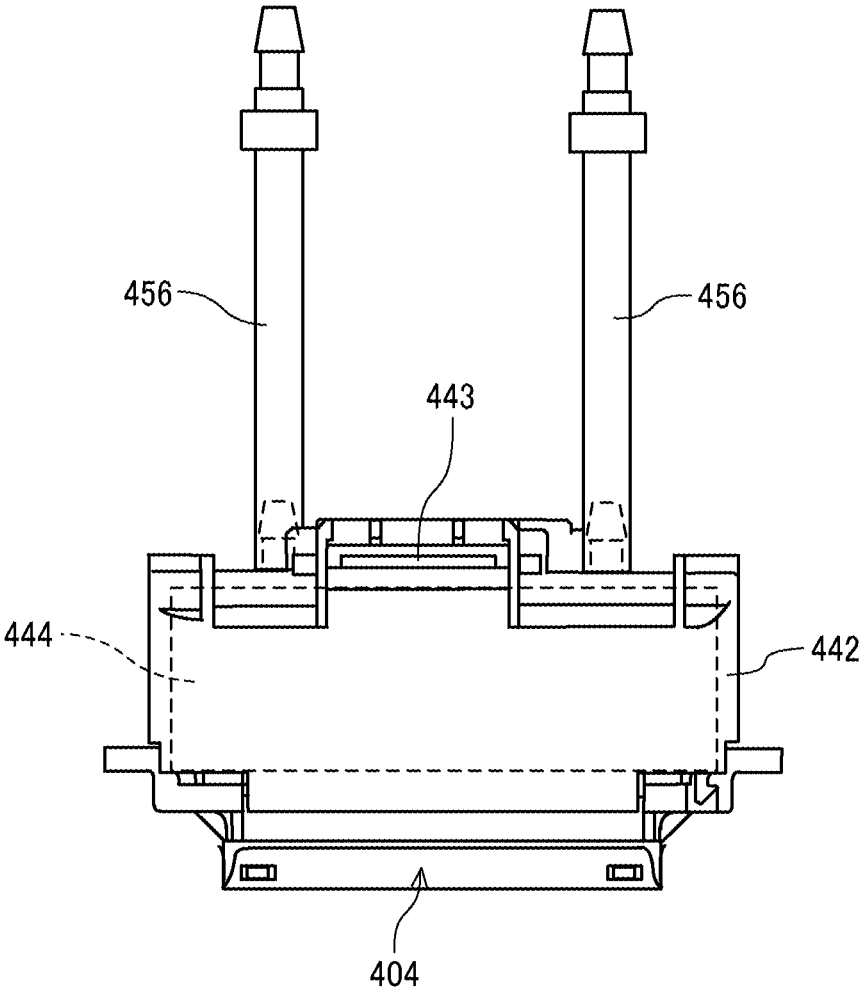
FIG. 28 is a schematic view illustrating another example of a liquid discharge device according to an embodiment of the present invention.

Next, still another example of the liquid discharge device according to an embodiment of the present disclosure will be described with reference to FIG. 28. FIG. 28 is a front explanatory view of the device.

This liquid discharge device includes the liquid discharge head 404 having a channel component 444 attached thereto and a tube 456 coupled to the channel component 444.

Note that the channel component 444 is disposed in a cover 442. Instead of the channel component 444, the head tank 441 can be included. A connector 443 that makes electrical connection with the liquid discharge head 404 is disposed on an upper part of the channel component 444.

In the present application, the "liquid discharge apparatus" includes a liquid discharge head or a liquid discharge device, and drives the liquid discharge head to discharge liquid. The "liquid discharge apparatus" includes not only an apparatus capable of discharging liquid onto a liquid-attachable object but also an apparatus that discharges liquid toward gas or liquid.

This "liquid discharge apparatus" may also include a means related to feeding, conveying, or sheet ejection of a liquid-attachable object, a pretreatment device, a post-treatment device, and the like.

Examples of the "liquid discharge apparatus" include an image forming apparatus that discharges ink to form an image on a sheet and a stereoscopic modeling apparatus (three-dimensional modeling apparatus) that discharges modeling liquid onto a powder layer obtained by forming powder into a layer shape in order to model a stereoscopic modeled object (three-dimensional modeled object).

The "liquid discharge apparatus" is not limited to an apparatus in which a significant image such as a letter or a figure is visualized by discharged liquid. Examples of the "liquid discharge apparatus" include an apparatus that forms a pattern or the like having no meaning by itself and an apparatus that models a three-dimensional image.

The "liquid-attachable object" means an object to which liquid can be attached at least temporarily, and means an object causing adhesion by attachment, an object causing permeation by attachment, or the like. Specific examples of the "liquid-attachable object" include a recording medium such as a sheet, recording paper, a recording sheet, a film, or a cloth, an electronic component such as an electronic substrate or a piezoelectric element, and a medium such as a powder layer, an organ model, or a test cell. Unless particularly limited, the "liquid-attachable object" includes everything to which liquid is attached.

A material of the "liquid-attachable object" may be any material as long as liquid can be attached to the object even temporarily, for example, paper, yarn, fiber, cloth, leather, metal, plastic, glass, wood, ceramics, a building material such as wall paper or a floor material, or a clothing textile.

The "liquid" also includes ink, processing liquid, a DNA sample, a resist, a pattern material, a binder, modeling liquid, a solution and a dispersion liquid containing amino acid, protein, or calcium, and the like.

The "liquid discharge apparatus" includes an apparatus in which a liquid discharge head and a liquid-attachable object move relatively to each other, but is not limited thereto. Specific examples thereof include a serial type apparatus that moves a liquid discharge head and a line type apparatus that does not move a liquid discharge head.

Examples of the "liquid discharge apparatus" further include a treatment liquid application apparatus that discharges treatment liquid onto a sheet in order to apply the treatment liquid to a surface of the sheet, for example, in order to modify the surface of the sheet, and a spraying granulation apparatus that sprays composition liquid in which a raw material is dispersed in a solution via a nozzle to granulate fine particles of the raw material.

The "liquid discharge device" is formed by integrating a functional component and a mechanism with a liquid discharge head, and includes an assembly of components related to discharge of liquid. Examples of the "liquid discharge device" include a device formed by combining at least one of configurations of a head tank, a carriage, a supply mechanism, a maintenance recovery device, and a main-scanning moving mechanism with a liquid discharge head.

Here, examples of the integration include a form in which a liquid discharge head, a functional component, and a mechanism are secured to each other by fastening, bonding, engagement, or the like, and a form in which one is held movably with respect to the other. A liquid discharge head, a functional component, and a mechanism may be detachable from each other.

Example of the liquid discharge device include a device in which a liquid discharge head and a head tank are integrated with each other like the liquid discharge device 440 illustrated in FIG. 26. Example of the liquid discharge device further include a device in which a liquid discharge head and a head tank are coupled to each other with a tube or the like to be integrated with each other. Here, a device including a filter may be added between a head tank of the liquid discharge device and a liquid discharge head thereof.

Examples of the liquid discharge device further include a device in which a liquid discharge head is integrated with a carriage.

Examples of the liquid discharge device further include a device in which a liquid discharge head is movably held by a guide constituting a part of a main-scanning moving mechanism and the liquid discharge head is integrated with the main-scanning moving mechanism. Example of the liquid discharge device further include a device in which a liquid discharge head, a carriage, and a main-scanning moving mechanism are integrated with each other as illustrated in FIG. 27.

Examples of the liquid discharge device further include a device in which a cap which is a part of a maintenance recovery device is secured to a carriage to which a liquid discharge head is attached to integrate the liquid discharge head, the carriage, and the maintenance recovery device with each other.

Example of the liquid discharge device further include a device in which a tube is coupled to a liquid discharge head to which a head tank or a channel component is attached to integrate the liquid discharge head and a supply mechanism with each other as illustrated in FIG. 28.

The main-scanning moving mechanism also includes a single guide member. The supply mechanism also includes a single tube and a single loading unit.

A pressure generator used by the "liquid discharge head" is not limited. In addition to the piezoelectric actuator (a laminated type piezoelectric element may be used) as described in the above embodiment, a thermal actuator using an electrothermal transducer such as a heating resistor, an electrostatic actuator including a diaphragm plate and a counter electrode, and the like may be used.

In the terms of the present application, image formation, recording, letter printing, photograph printing, printing, modeling, and the like are all synonymous.

Figure 29:
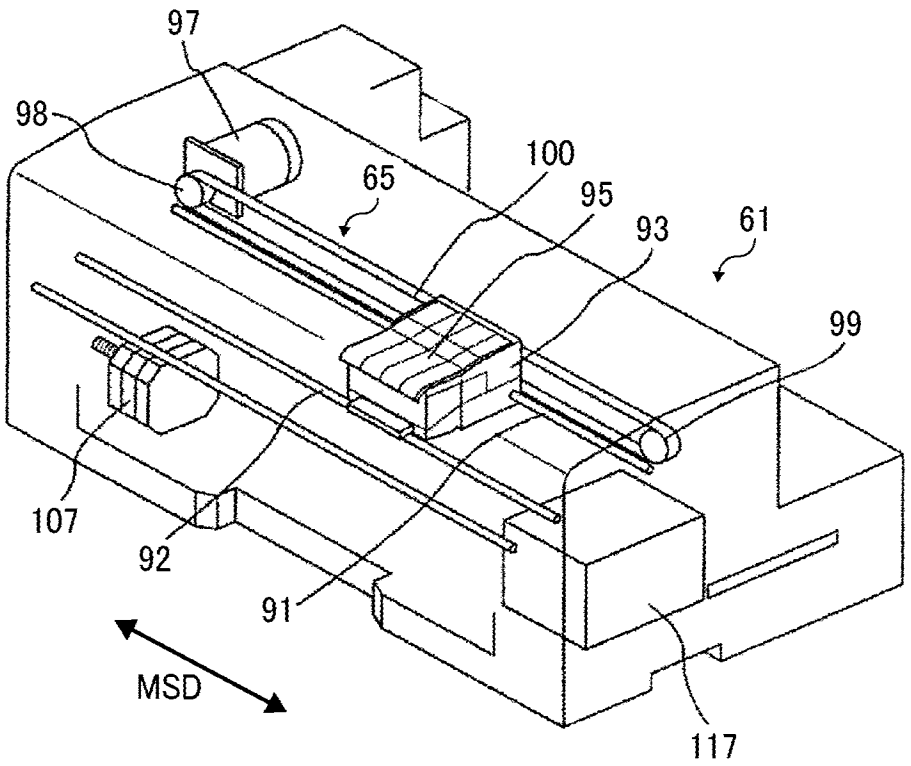
FIG. 29 is a perspective view illustrating an example of a configuration of an image forming apparatus.
Figure 30:
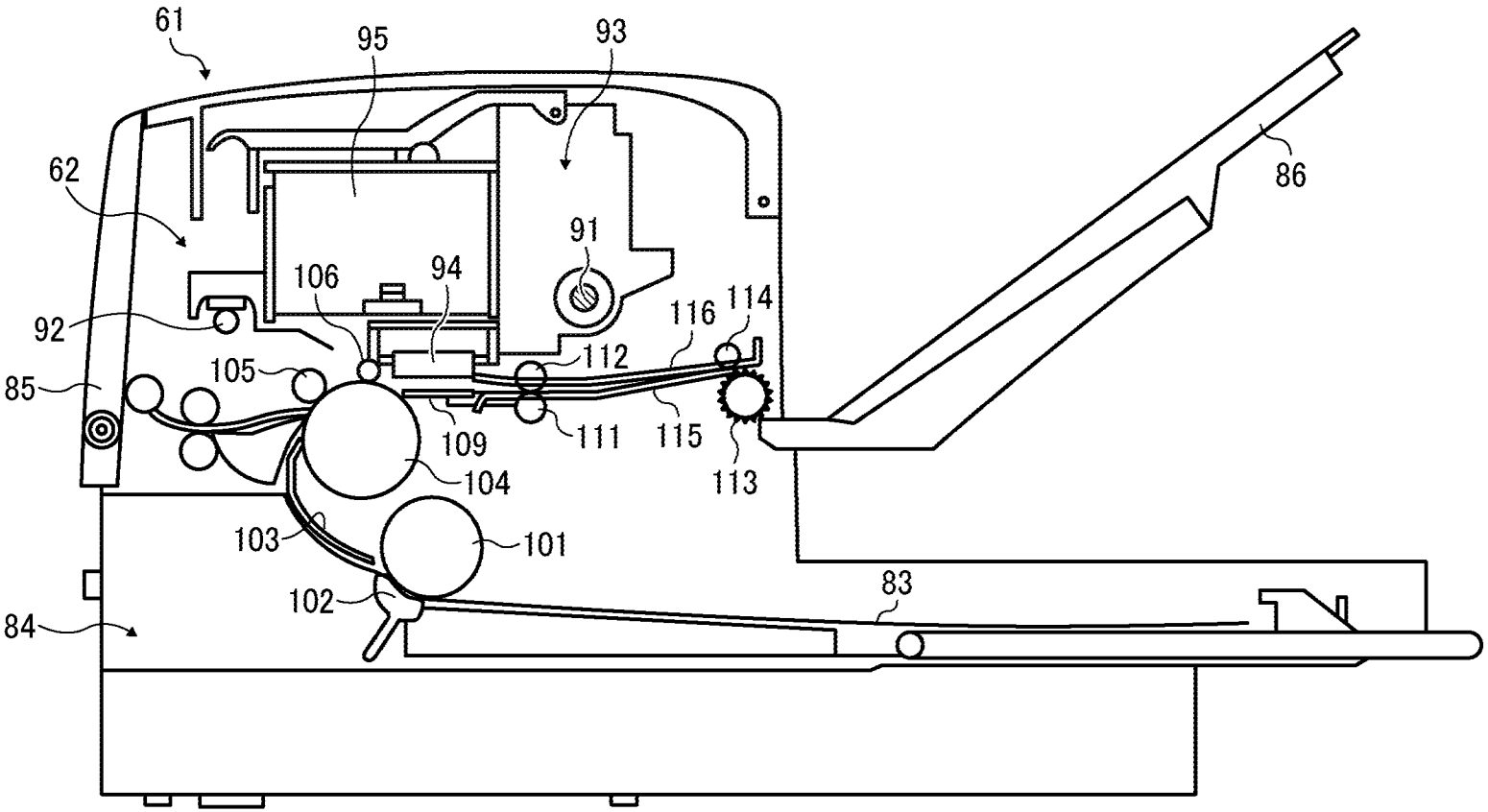
FIG. 30 is a side view illustrating an example of a configuration of an image forming apparatus.

Next, an example of the liquid discharge apparatus according to an embodiment of the present disclosure will be described with reference to FIGS. 29 and 30. FIG. 29 is a perspective explanatory view of the apparatus, and FIG. 30 is a side explanatory view of a mechanism portion of the apparatus. Note that hereinafter, the liquid discharge apparatus will be described with an inkjet recording apparatus as an example, but the liquid discharge apparatus is not limited thereto.

The inkjet recording apparatus according to the present embodiment houses, in a recording apparatus body 61, for example, a printing mechanism section 65 including a carriage that can move in a main scanning direction, a recording head including an inkjet head according to an embodiment of the present disclosure mounted on the carriage, and an ink cartridge that supplies ink to the recording head. To a lower part of the apparatus body 61, a sheet feed cassette (or sheet feed tray) 84 on which a large number of sheets of paper 83 can be stacked from a front side can be attached in a freely detachable manner. A bypass tray 85 for manually feeding the sheet 83 can be opened. The inkjet recording apparatus takes in the sheet 83 fed from the sheet feed cassette 84 or the bypass tray 85, records a required image with the printing mechanism section 65, and then ejects the sheet 83 to a sheet ejection tray 86 attached to a rear side.

The printing mechanism section 65 holds a carriage 93 slidably in a main scanning direction with a main guide rod 91 and a sub-guide rod 92 which are guides laterally bridged on left and right side plates. In the carriage 93, heads 94 including the inkjet heads that discharge ink droplets of colors of yellow (Y), cyan (C), magenta (M), and black (Bk) according to an embodiment of the present disclosure are arranged such that a plurality of ink discharge ports (nozzles) intersects with the main scanning direction. The heads 94 are attached with an ink droplet discharge direction downward. Each ink cartridge 95 for supplying ink of each color to the head 94 is attached to the carriage 93 in a replaceable manner.

The ink cartridge 95 has an air port that communicates with the atmosphere in an upper part thereof, a supply port that supplies ink to the inkjet head in a lower part thereof, and a porous body filled with ink inside. The ink supplied to the inkjet head is maintained at a slight negative pressure due to a capillary force of the porous body. Although the heads 94 of the colors are used here as the recording heads, a single head having nozzles that discharge ink droplets of the colors may be used.

Here, the carriage 93 is slidably fitted to the main guide rod 91 on a rear side (downstream side in a sheet conveyance direction), and slidably mounted on the sub-guide rod 92 on a front side (upstream side in the sheet conveyance direction). In order to move the carriage 93 for scanning in the main scanning direction, a timing belt 100 is stretched between a driving roller 98 and a driven roller 99 that are rotationally driven by a main scanning motor 97, and the timing belt 100 is secured to the carriage 93. The carriage 93 is reciprocatingly driven by forward and reverse rotation of the main scanning motor 97.

Meanwhile, in order to convey the sheet 83 set in the sheet feed cassette 84 to a lower side of the head 94, a sheet feed roller 101 and a friction pad 102 that separate and feed the sheet 83 from the sheet feed cassette 84, a guide 103 that guides the sheet 83, a conveyance roller 104 that reverses and conveys the fed sheet 83, a conveyance roller 105 that is pressed against a peripheral surface of the conveyance roller 104, and a leading-end roller 106 that defines a feeding angle of the sheet 83 from the conveyance roller 104 are disposed. The conveyance roller 104 is rotationally driven by a sub-scanning motor 107 via a gear train.

A print receiving member 109, which is a sheet guide that guides the sheet 83 fed from the conveyance roller 104 on a lower side of the recording head 94 corresponding to a movement range of the carriage 93 in the main scanning direction, is disposed. On a downstream side of the print receiving member 109 in a sheet conveyance direction, a conveyance roller 111 and a spur roller 112 that are rotationally driven for sending out the sheet 83 in a sheet ejection direction are disposed. Furthermore, a sheet ejection roller 113 and a spur roller 114 that send out the sheet 83 to the sheet ejection tray 86, and guides 115 and 116 forming a sheet ejection path are disposed.

During recording, the recording head 94 is driven according to an image signal while the carriage 93 is moved. Ink is thereby discharged onto the sheet 83 being stopped to record one line, and the sheet 83 is conveyed by a predetermined amount. Thereafter, a subsequent line is recorded. Upon receiving a recording end signal or a signal indicating that a trailing edge of the sheet 83 has reached a recording area, recording operation is terminated and the sheet 83 is ejected.

At a position outside the recording area on a right end side of the carriage 93 in a movement direction thereof, a recovery device 117 for recovering discharge failure of the head 94 is disposed. The recovery device 117 includes a capping means, a suction means, and a cleaning means. While waiting for printing, the carriage 93 is moved to a side of the recovery device 117, and the head 94 is capped by the capping means. A discharge port is kept in a wet state to prevent discharge failure due to ink drying. Ink not related to recording during recording or the like is discharged, and the ink viscosity at all the discharge ports is thereby made constant to maintain stable discharging performance.

For example, when discharge failure occurs, the discharge port (nozzle) of the head 94 is sealed with the capping means, bubbles and the like are sucked out together with ink from the discharge port with the suction means through a tube, and ink, dust, or the like adhering to a surface of the discharge port is removed by the cleaning means to recover the discharge failure. The sucked ink is discharged to a waste ink reservoir disposed at a lower part of the body, and is absorbed and held by an ink absorber inside the waste ink reservoir.

As described above, the liquid discharge apparatus according to the present embodiment includes the liquid discharge head according to the present embodiment, and therefore can obtain highly reliable and stable ink droplet discharge characteristics, thus improving image quality.

EXAMPLES

Hereinafter, embodiments of the present disclosure will be described more specifically with reference to Examples and Comparative Example, but the present disclosure is not limited by these Examples.

Example 1

A 6-inch silicon wafer was thermally oxidized to form a silicon oxide film $SiO_2$ (film thickness: 1 μm) as a diaphragm plate. As an adhesion film for a first electrode, a titanium film (film thickness: 30 nm) was formed using a sputtering apparatus. Next, the titanium film was thermally oxidized at 750° C. using RTA, and subsequently a platinum film (film thickness: 100 nm) was formed as a metal film by sputtering. Film formation was performed at a substrate heating temperature of 550° C. during sputtering film formation.

Next, a solution adjusted to Pb:Zr:Ti=114:53:47 was prepared as a piezoelectric film, and a film was formed by a spin coating method. For synthesis of a specific precursor coating liquid, lead acetate trihydrate, isopropoxide titanium, and normal propoxide zirconium were used as starting materials. Crystal water of lead acetate was dissolved in methoxyethanol and then dehydrated. The lead amount was excessive with respect to a stoichiometric composition. This is for preventing crystallinity deterioration due to so-called lead loss during a heat treatment. Isopropoxide titanium and normal propoxide zirconium were dissolved in methoxyethanol, an alcohol exchange reaction and an esterification reaction were caused to proceed, and the resulting product was mixed with the above-described methoxyethanol solution in which lead acetate was dissolved to synthesize a PZT precursor solution. The PZT concentration was set to 0.5 mol/l. Using this solution, a film was formed by spin coating. After film formation, the film was dried at 120° C. and pyrolyzed at 500° C. The third layer was pyrolyzed, and then a crystallization heat treatment (temperature: 750° C.) was performed by RTA. At this time, PZT had a film thickness of 240 nm. This step was performed eight times in total (24 layers) to obtain a film thickness of about 2 μm.

Next, an SrRuO film (film thickness: 40 nm) was formed as an oxide film of the second electrode, and a Pt film (film thickness: 125 nm) was formed as a metal film thereof by sputtering. Thereafter, a film of a photoresist (TSMR8800) manufactured by Tokyo Ohka Kogyo Co., Ltd. was formed by a spin coating method, and a resist pattern was formed by ordinary photolithography. Thereafter, the Pt film and the oxide film were etched using an ICP etching apparatus (manufactured by Samco Inc.). Thereafter, a resist stripping treatment was performed for 30 minutes using an amine-based stripping liquid with a resist stripping apparatus manufactured by Semitool, and an ashing treatment was performed for three minutes with an asher manufactured by Canon Inc. to pattern a second electrode (individual electrode) (FIGS. 7A and 7B).

At this time, rows of the electro-mechanical transducer elements disposed at both ends of the common electrode in a longitudinal direction thereof and one end of a short direction thereof in the plan views of FIGS. 7A and 7B are not elements to be actually driven but are elements that function as dummy structures 170. That is, in FIGS. 7A and 7B, the electro-mechanical transducer elements in the area indicated by the broken lines are the dummy structures 170.

Similarly, a resist pattern was formed by photolithography, and then the piezoelectric film was etched. A resist stripping treatment and an ashing treatment were performed, and the piezoelectric film was patterned (FIGS. 8A and 8B). In the present Example, as illustrated in FIGS. 5A and 5B, the first electrode is a common electrode, and the second electrode is an individual electrode.

Next, patterns of the electrode (common electrode) and through holes were formed by photolithography, and then a resist stripping treatment and an ashing treatment were performed to form a first electrode (common electrode) and a through hole (FIG. 5A).

Figure 31:
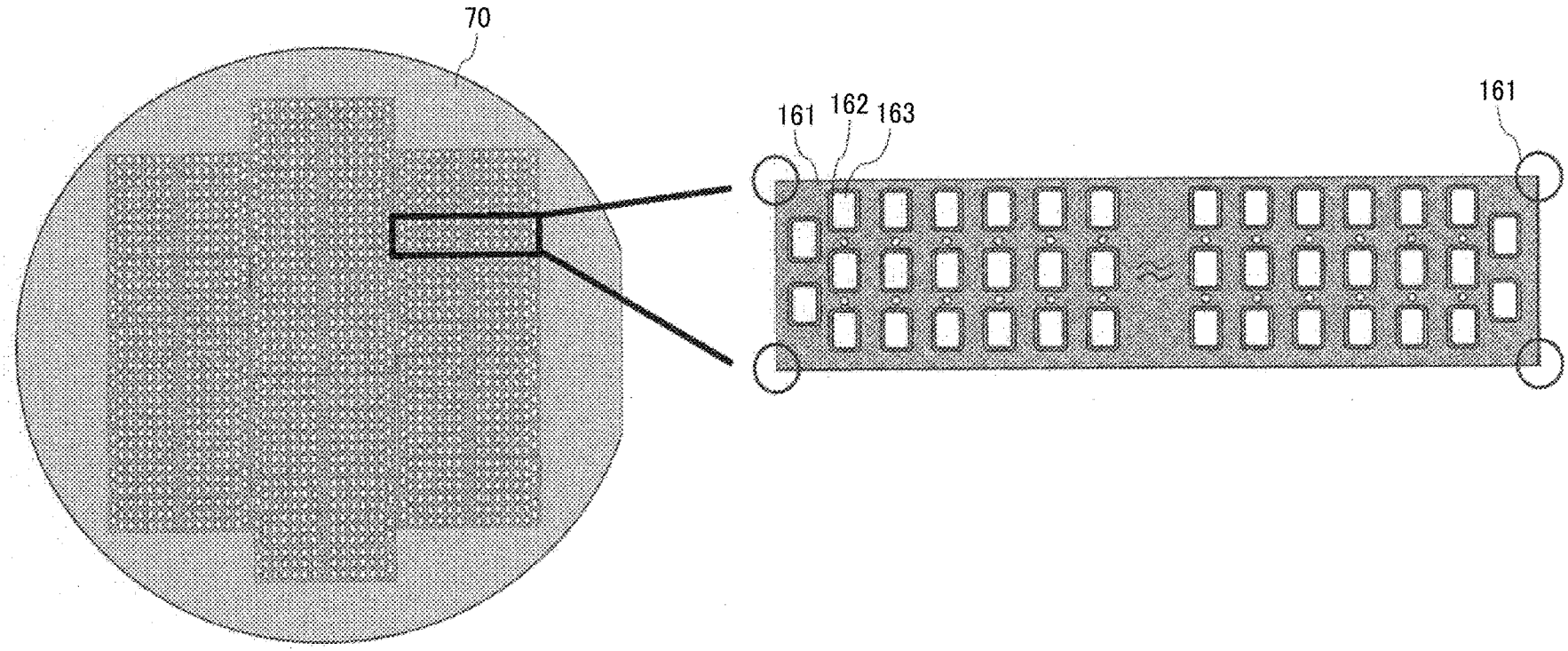
FIG. 31 is a conceptual view when a plurality of electromechanical transducer elements is formed in a wafer in Example.

In the electro-mechanical transducer manufactured so far, the number of peeled corners in the first electrode (common electrode) and the number of peeled through holes were counted, and the peeling ratios thereof were calculated. As illustrated in FIG. 31, 36 electro-mechanical transducers (chips) were formed on a substrate, and in each of the electro-mechanical transducers, four corners and 400 through holes were formed. The parameter of the corner of the first electrode (common electrode) in the substrate is 144 (36 electro-mechanical transducers×4 corners=144), and the parameter of the through hole is 14400 (36 electro-mechanical transducers×400 through holes=14400).

Example 2

An electro-mechanical transducer was manufactured in a similar manner to Example 1 except that the first electrode was an individual electrode and the second electrode was a common electrode as illustrated in FIGS. 6A and 6B. The number of peeled corners in the first electrode (common electrode) and the number of peeled through holes were counted, and the peeling ratios were calculated.

Example 3

An electro-mechanical transducer was manufactured in a similar manner to Example 1 except that the dummy structure was not disposed as illustrated in FIG. 13. The number of peeled corners in the first electrode (common electrode) and the number of peeled through holes were counted, and the peeling ratios were calculated.

Example 4

An electro-mechanical transducer was manufactured in a similar manner to Example 3 except that the shape of the through hole was rectangular as illustrated in FIG. 14. The number of peeled corners in the first electrode (common electrode) and the number of peeled through holes were counted, and the peeling ratios were calculated.

Example 5

An electro-mechanical transducer was manufactured in a similar manner to Example 1 except that the shape of the through hole was rectangular as illustrated in FIG. 15. The number of peeled corners in the first electrode (common electrode) and the number of peeled through holes were counted, and the peeling ratios were calculated.

Example 6

An electro-mechanical transducer was manufactured in a similar manner to Example 3 except that the number of through holes formed was doubled to 800 as illustrated in FIG. 16. The number of peeled corners in the first electrode (common electrode) and the number of peeled through holes were counted, and the peeling ratios were calculated. The parameter of the corner is doubled to 28800.

Comparative Example 1

Figure 32:
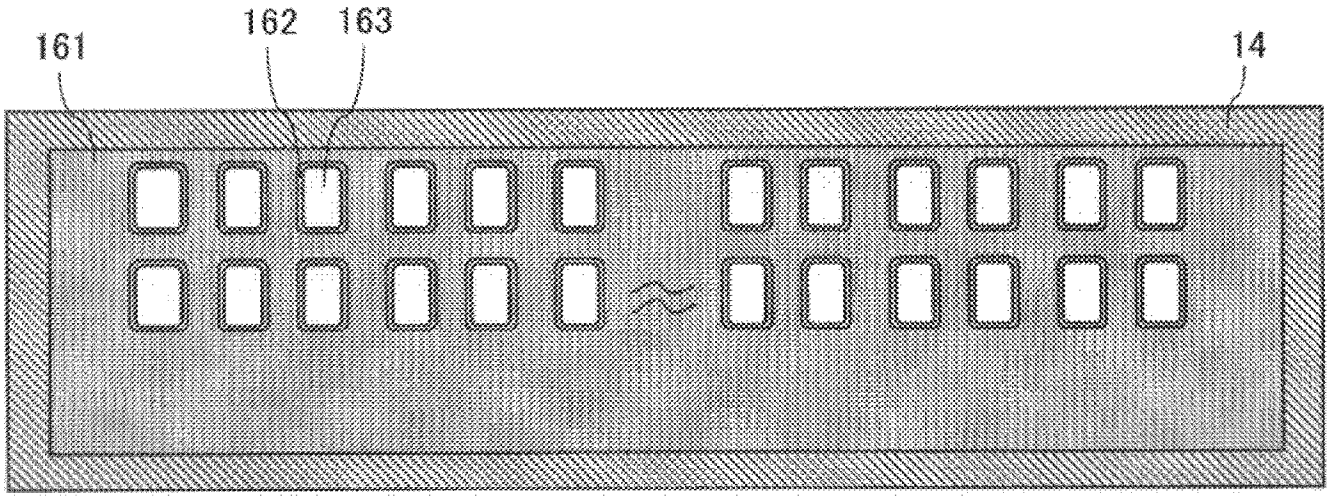
FIG. 32 is a plan view illustrating a common electrode in Comparative Example.

The electro-mechanical transducer was manufactured in a similar manner to Example 3 except that no through hole was formed as illustrated in FIG. 32. The number of peeled corners in the first electrode (common electrode) and the number of peeled through holes were counted, and the peeling ratios were calculated.

Evaluation

Evaluation of Peeling Occurrence Ratio

Figure 33:
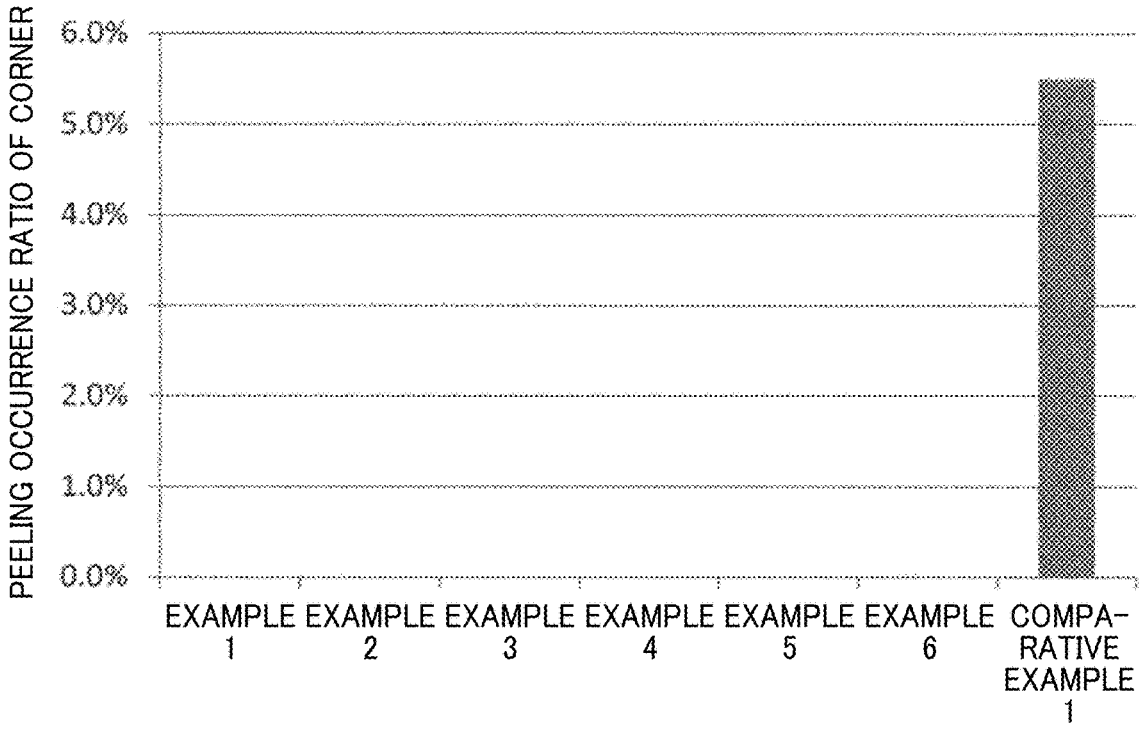
FIG. 33 is a graph illustrating a peeling occurrence ratio of a corner in Examples and Comparative Example.
Figure 34:
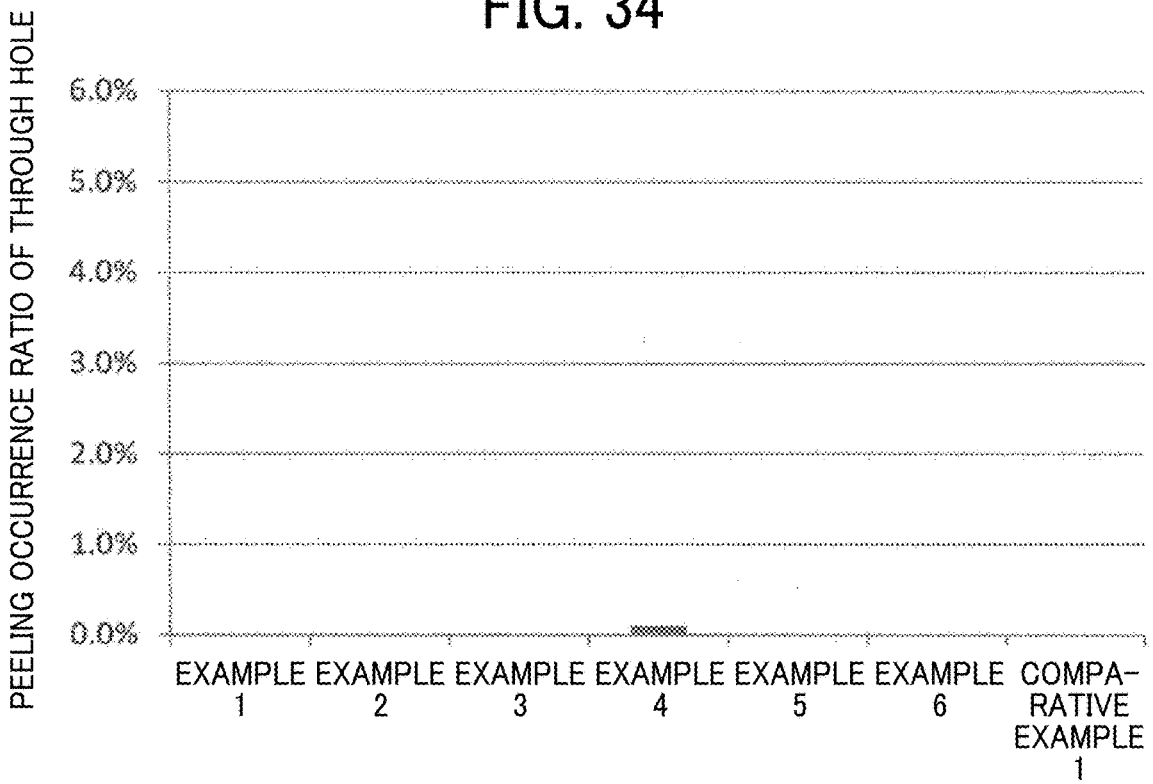
FIG. 34 is a graph illustrating a peeling occurrence ratio of a through hole in Examples and Comparative Example.

In each of Examples 1 to 6, four substrates were manufactured. FIG. 33 illustrates the peeling occurrence ratio of the counted corners, and FIG. 34 illustrates the peeling occurrence ratio of the through holes.

Regarding the corner, about 5% of peeling was observed in Comparative Example 1, while the peeling occurrence ratio was 0% in each of Examples in which a through hole was formed. Regardless of the shape of the through hole, by forming the hole itself, a film stress was relaxed and peeling was suppressed. There was no difference in the comparison between Examples. However, more holes were formed in Example 6. Therefore, for example, when a film with a high stress is formed or when a shape that easily causes peeling is formed, the effect in Example 6 is considered to be more remarkable than those in the other Examples.

Regarding the through hole, peeling was slightly observed only in Example 4. Regarding the shape of the through hole, it is considered that a stress distribution is more uniform to suppress peeling in a circular shape than in a rectangular shape with corners. However, the numerical values are low and acceptable. In Example 5 in which the structure is disposed, the shape of the through hole was rectangular, but no peeling occurred. It is considered that the structure disposed around the through hole played a role of guarding the through hole from the stripping liquid at the time of resist stripping, and therefore peeling did not occur.

From the above, it is found that formation of the through hole in the common electrode can suppress peeling significantly, and can provide a highly reliable electro-mechanical transducer. In addition, it is found that the structure in the through hole can also suppress peeling of the through hole.

Discharge Evaluation

Wiring and a driving unit were mounted on the electro-mechanical transducer manufactured in Example 3, a pressure chamber as illustrated in FIG. 3 was formed, and a nozzle plate was bonded thereto to manufacture a liquid discharge head. Discharge of liquid was evaluated for the manufactured liquid discharge head. When a voltage of −10 to 30 V was applied by simple push waveform using ink with viscosity adjusted to 5 cp, a discharge status was checked. As a result, it was confirmed that liquid could be discharged from all nozzle holes. Furthermore, continuous discharge endurance evaluation was performed. As a result, it was confirmed that discharge could be performed without any disadvantages even after driving 10 billion times.

Note that in the configuration of Comparative Example 1, since it is necessary to form a supply hole for supplying ink outside the common electrode, it is necessary to slightly increase the chip size. Therefore, it is preferable to form a through hole in the common electrode as in Examples, and to use the through hole as an ink supply hole also from a viewpoint of yield.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An electro-mechanical transducer, comprising:

a diaphragm plate on a substrate;

a first electrode on the diaphragm plate;

an electro-mechanical transducer film on the first electrode; and a second electrode on the electro-mechanical transducer film, wherein one of the first electrode and the second electrode is a common electrode, another of the first electrode and the second electrode is an individual electrode, at least a portion of the common electrode is laminated on and in contact with the diaphragm plate, and the common electrode has a plurality of holes penetrating the common electrode in a lamination direction, the plurality of holes further penetrating the diaphragm plate.

2. The electro-mechanical transducer according to claim 1, wherein the holes penetrating the common electrode are circular when viewed from the lamination direction.

3. The electro-mechanical transducer according to claim 1, wherein the holes penetrating the common electrode are arranged at equal intervals.

4. The electro-mechanical transducer according to claim 1, further comprising a plurality of electro-mechanical transducer elements arranged in rows on the diaphragm plate, each of the plurality of electro-mechanical transducer elements including the first electrode, the electro-mechanical transducer film, and the second electrode, wherein, of the plurality of electro-mechanical transducer elements, electro-mechanical transducer elements constituting a row arranged on an end side on the diaphragm plate is dummy electro-mechanical transducer elements.

5. The electro-mechanical transducer according to claim 1, further comprising a plurality of electro-mechanical transducer films, including the electro-mechanical transducer film, on the substrate, wherein a number of the holes penetrating the common electrode is larger than a number of Me plurality of electro-mechanical transducer films.

6. The electro-mechanical transducer according to claim 1, wherein the common electrode includes an adhesion layer in contact with the diaphragm plate and a metal electrode film on the adhesion layer, the adhesion layer includes $TiO_2$, and the metal electrode film includes Pt.

7. The electro-mechanical transducer according to claim 6, wherein the diaphragm plate has a laminated structure, and a layer of the diaphragm plate in contact with the adhesion layer includes any one of Si, $SiO_2$, $Al_2O_3$, and $Si_3N_4$.

8. A liquid discharge head comprising:

a pressure chamber communicating with a nozzle configured to discharge liquid; and the electro-mechanical transducer according to claim 1 configured to generate a pressure in the liquid in the pressure chamber.

9. The liquid discharge head according to claim 8, wherein the holes of the common electrode also serve as supply holes configured to supply the liquid to the pressure chamber.

10. A liquid discharge device comprising the liquid discharge head according to claim 8.

11. The liquid discharge device according to claim 10, wherein the liquid discharge head is integrated as a single unit with at least one of:

a head tank configured to store the liquid to be supplied to the liquid discharge head;

a carriage on which the liquid discharge head is mounted;

a supply mechanism configured to supply the liquid to the liquid discharge head;

a maintenance recovery device configured to perform maintenance and recovery of the liquid discharge head; and a main-scanning moving mechanism configured to move the liquid discharge head in a main scanning direction.

12. A liquid discharge apparatus comprising the liquid discharge device according to claim 10.

13. A liquid discharge apparatus comprising the liquid discharge head according to claim 8.

14. An electro-mechanical transducer, comprising:

a diaphragm plate on a substrate;

a first electrode on the diaphragm plate;

an electro-mechanical transducer film on the first electrode; and a second electrode on the electro-mechanical transducer film, wherein one of the first electrode and the second electrode is a common electrode, another of the first electrode and the second electrode is an individual electrode, at least a portion of the common electrode is laminated on and in contact with the diaphragm plate, the common electrode has a plurality of holes penetrating the common electrode in a lamination direction, the electro-mechanical transducer further comprises a plurality of electro-mechanical transducer elements arranged in rows on the diaphragm plate, each of the plurality of electro-mechanical transducer elements including the first electrode, the electro-mechanical transducer film, and the second electrode, and wherein, of the plurality of electro-mechanical transducer elements, electro-mechanical transducer elements constituting a row arranged on an end side on the diaphragm plate is dummy electro-mechanical transducer elements.

15. An electro-mechanical transducer, comprising:

a diaphragm plate on a substrate;

a first electrode on the diaphragm plate;

an electro-mechanical transducer film on the first electrode; and a second electrode on the electro-mechanical transducer film, wherein one of the first electrode and the second electrode is a common electrode, another of the first electrode and the second electrode is an individual electrode, at least a portion of the common electrode is laminated on and in contact with the diaphragm plate, the common electrode has a plurality of holes penetrating the common electrode in a lamination direction, the transducer further comprises a plurality of electro-mechanical transducer films, including the electro-mechanical transducer film, on the substrate, and wherein a number of the holes penetrating the common electrode is larger than a number of the plurality of electro-mechanical transducer films.

* * * * *